US009860669B2

(12) United States Patent
De Bruijn et al.

(10) Patent No.: US 9,860,669 B2
(45) Date of Patent: Jan. 2, 2018

(54) AUDIO APPARATUS AND METHOD THEREFOR

(71) Applicant: KONINKLIJKE PHILIPS N.V., Eindhoven (NL)

(72) Inventors: Werner Paulus Josephus De Bruijn, Utrecht (NL); Arnoldus Werner Johannes Oomen, Eindhoven (NL); Aki Sakari Haermae, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 46 days.

(21) Appl. No.: 14/786,679

(22) PCT Filed: May 6, 2014

(86) PCT No.: PCT/IB2014/061226
§ 371 (c)(1),
(2) Date: Oct. 23, 2015

(87) PCT Pub. No.: WO2014/184706
PCT Pub. Date: Nov. 20, 2014

(65) Prior Publication Data

US 2016/0073215 A1 Mar. 10, 2016

(30) Foreign Application Priority Data

May 16, 2013 (EP) ..... 13168064
Jan. 2, 2014 (EP) ..... 14150062

(51) Int. Cl.
*H04R 5/00* (2006.01)
*H04S 7/00* (2006.01)
*G10L 19/008* (2013.01)

(52) U.S. Cl.
CPC ..... *H04S 7/308* (2013.01); *G10L 19/008* (2013.01); *H04R 2205/024* (2013.01); *H04S 2400/03* (2013.01); *H04S 2400/11* (2013.01)

(58) Field of Classification Search
USPC ..... 381/17, 26, 81, 300, 309, 14, 55, 71.7, 381/150
See application file for complete search history.

(56) References Cited

U.S. PATENT DOCUMENTS 4,783,804 A * 11/1988 Juang ..... G10L 15/14 704/245
8,160,280 B2 4/2012 Strauss et al.
(Continued)

FOREIGN PATENT DOCUMENTS

FR 2970574 A1 7/2012
WO 2013006338 A2 1/2013

OTHER PUBLICATIONS

Van Veen et al, "Beamforming: A Versatile Approach to Spatial Filtering", IEEE ASSP Magazine, 1988, pp. 4-24.
(Continued)

*Primary Examiner* — Yosef K Laekemariam

(57) ABSTRACT

An audio apparatus includes a receiver configured to receive audio data and audio transducer position data for a plurality of audio transducers; and a renderer configured to render the audio data by generating audio transducer drive signals for the audio transducers from the audio data. Further, a clusterer is configured to cluster the audio transducers into a set of clusters in response to the audio transducer position data and to distances between audio transducers in accordance with a distance metric. A render controller is configured to adapt the rendering in response to the clustering. The apparatus is configured to select array processing techniques for specific subsets that contain audio transducers that are sufficiently close and allow automatic adaptation to audio
(Continued)

transducer configurations thereby, e.g., allowing a user increased flexibility in positioning loudspeakers.

14 Claims, 10 Drawing Sheets

(56) References Cited

U.S. PATENT DOCUMENTS

2013/0101122 A1* 4/2013 Yoo ..... G10L 19/008 381/17
2014/0003619 A1 1/2014 Sannie et al.

OTHER PUBLICATIONS

Kirkeby et al, "Design of Cross-Talk Cancellation Networks by Using Fast Deconvolution", AES Convention: 106, Papers No. 4916, 1999, pp. 1-13.
Kirkeby et al, "The 'Stereo Dipole'—A Virtual Source Imaging System Using Two Closely Spaced Loudspeakers", JAES vol. 46, Issue 5, 1998, pp. 387-395.
Boone et al, "Sound Reproduction Applications With Wave-Field Synthesis", AES Convention: 104, Paper No. 4689, 1998, pp. 1-10.
Shin et al, "Efficient 3D Sound Field Reproducction", AES Convention: 130, Paper No. 8404, 2011, pp. 1-10
Pulkki, "Virtual Sound Source Positioning Using Vector Base Amplitude Panning", J. Audio Eng. Soc., vol. 45, No. 6, 1997, pp. 456-466.
Theile et al, "Wave Field Synthesis: A Promising Spatial Audio Rendering Concept", XP-002409670, Acoust. Sci. & Tech., vol. 25, No. 6, 2004, pp. 393-399.
Madhulatha, An Overview on Clustering Methods, IOSR Journal of Engineering, vol. 2, No. 4, 2012, pp. 719-725.
"Cluster Analysis", Downloaded From http://en.wikipedia,org/wiki/cluster_analysis, Oct. 23, 2015, 18 Pages.
"Hierarchical Clustering", Downloaded From https://en.wikipedia.org/wiki/hierarchical_clusltering, Oct. 23, 2015, 8 Pages.

* cited by examiner

| Level 1 | Level 2 | Level 3 | Level 4 | $\delta_{max}$(m) | $L$(m) | $f_{max}$(kHz) |
|---|---|---|---|---|---|---|
| (1,2) | | | | 0.22 | 0.22 | 0.8 |
| (1,16) | | | | 0.14 | 0.14 | 1.2 |
| | (1,2,16) | | | 0.22 | 0.30 | 0.8 |
| (3,4) | | | | 0.15 | 0.15 | 1.1 |
| | | (1,2,3,4,16) | | 0.25 | 0.63 | 0.7 |
| (15,16) | | | | 0.45 | 0.45 | 0.4 |
| | | | (1,2,3,4,15,16) | 0.45 | 1.00 | 0.4 |
| (8,9) | | | | 0.18 | 0.18 | 1.0 |
| (9,10) | | | | 0.20 | 0.20 | 0.9 |
| | (8,9,10) | | | 0.20 | 0.36 | 0.9 |

FIG. 8

| Cluster | $\delta_{max}$(m) | $L$(m) | $f_{max}$(kHz) |
|---|---|---|---|
| (8,9) | 0.02 | 0.02 | 17 |
| (1,16) | 0.10 | 0.10 | 3.4 |
| (8,9,10) | 0.13 | 0.16 | 2.6 |
| (3,4) | 0.15 | 0.15 | 2.3 |
| (2,3,4) | 0.18 | 0.33 | 1.9 |
| (1,2,3,4,16) | 0.21 | 0.62 | 1.6 |
| (8,9,10,11) | 0.33 | 0.50 | 1.0 |
| (1,2,3,4,15,16) | 0.43 | 1.0 | 0.8 |
| (1,2,3,4,5,15,16) | 0.49 | 1.4 | 0.7 |

FIG. 10

AUDIO APPARATUS AND METHOD THEREFOR

CROSS-REFERENCE TO PRIOR APPLICATIONS

This application is the U.S. National Phase application under 35 U.S.C. §371 of International Application No. PCT/IB2014/061226, filed on May 6, 2014, which claims the benefit of European Patent Application No. 13168064.7, filed on May 16, 2013 and European Patent Application No. 14150062.9, filed on Jan. 2, 2014. These applications are hereby incorporated by reference herein.

FIELD OF THE INVENTION

The invention relates to an audio apparatus and method therefor, and in particular, but not exclusively, to adaptation of rendering to unknown audio transducer configurations.

BACKGROUND OF THE INVENTION

In recent decades, the variety and flexibility of audio applications has increased immensely with e.g. the variety of audio rendering applications varying substantially. On top of that, the audio rendering setups are used in diverse acoustic environments and for many different applications.

Traditionally, spatial sound reproduction systems have always been developed for one or more specified loudspeaker configurations. As a result, the spatial experience is dependent on how closely the actual loudspeaker configuration used matches the defined nominal configuration, and a high quality spatial experience is typically only achieved for a system that has been set up substantially correctly, i.e. according to the specified loudspeaker configuration.

However, the requirement to use specific loudspeaker configurations with typically a relatively high number of loudspeakers is cumbersome and disadvantageous. Indeed, a significant inconvenience perceived by consumers when deploying e.g. home cinema surround sound systems is the need for a relatively large number of loudspeakers to be positioned at specific locations. Typically, practical surround sound loudspeaker setups will deviate from the ideal setup due to users finding it impractical to position the loudspeakers at the optimal locations, for example due to restrictions on available speaker locations in a living room. Accordingly the experience, and in particular the spatial experience, which is provided by such setups is suboptimal.

In recent years, there has therefore been a strong trend towards consumers demanding less stringent requirements for the location of their loudspeakers. Even more so, their primary requirement is that the loudspeaker set-up fits their home environment, while at the same time they of course expect the system to still provide a high quality sound experience and in particular an accurate spatial experience. These conflicting requirements become more prominent as the number of loudspeakers increases. Furthermore, the issues have become more relevant due to a current trend towards the provision of full three dimensional sound reproduction with sound coming to the listener from multiple directions.

Audio encoding formats have been developed to provide increasingly capable, varied and flexible audio services and in particular, audio encoding formats supporting spatial audio services have been developed.

Well known audio coding technologies like MPEG, DTS and Dolby Digital produce a coded multi-channel audio signal that represents the spatial image as a number of channels placed around the listener at fixed positions. For a loudspeaker setup which is different from the setup that corresponds to the multi-channel signal, the spatial image will be suboptimal. Also, channel based audio coding systems are typically not able to cope with a different number of loudspeakers.

(ISO/IEC) MPEG-2 provides a multi-channel audio coding tool where the bitstream format comprises both a 2 channel and a 5 multichannel mix of the audio signal. When decoding the bitstream with a (ISO/IEC) MPEG-1 decoder, the 2 channel backwards compatible mix is reproduced. When decoding the bitstream with a MPEG-2 decoder, three auxiliary data channels are decoded that when combined (de-matrixed) with the stereo channels result in the 5 channel mix of the audio signal.

(ISO/IEC MPEG-D) MPEG Surround provides a multi-channel audio coding tool that allows existing mono- or stereo-based coders to be extended to multi-channel audio applications. FIG. 1 illustrates an example of the elements of an MPEG Surround system. Using spatial parameters obtained by analysis of the original multichannel input, an MPEG Surround decoder can recreate the spatial image by a controlled upmix of the mono- or stereo signal to obtain a multichannel output signal.

Since the spatial image of the multi-channel input signal is parameterized, MPEG Surround allows for decoding of the same multi-channel bit-stream by rendering devices that do not use a multichannel loudspeaker setup. An example is virtual surround reproduction on headphones, which is referred to as the MPEG Surround binaural decoding process. In this mode a realistic surround experience can be provided while using regular headphones. Another example is the pruning of higher order multichannel outputs, e.g. 7.1 channels, to lower order setups, e.g. 5.1 channels.

As mentioned, the variation and flexibility in the rendering configurations used for rendering spatial sound has increased significantly in recent years with more and more reproduction formats becoming available to the mainstream consumer. This requires a flexible representation of audio. Important steps have been taken with the introduction of the MPEG Surround codec. Nevertheless, audio is still produced and transmitted for a specific loudspeaker setup, e.g. an ITU 5.1 loudspeaker setup. Reproduction over different setups and over non-standard (i.e. flexible or user-defined) loudspeaker setups is not specified. Indeed, there is a desire to make audio encoding and representation increasingly independent of specific predetermined and nominal loudspeaker setups. It is increasingly preferred that flexible adaptation to a wide variety of different loudspeaker setups can be performed at the decoder/rendering side.

In order to provide for a more flexible representation of audio, MPEG standardized a format known as 'Spatial Audio Object Coding' (ISO/IEC MPEG-D SAOC). In contrast to multichannel audio coding systems such as DTS, Dolby Digital and MPEG Surround, SAOC provides efficient coding of individual audio objects rather than audio channels. Whereas in MPEG Surround, each loudspeaker channel can be considered to originate from a different mix of sound objects, SAOC allows for interactive manipulation of the location of the individual sound objects in a multichannel mix as illustrated in FIG. 2.

Similarly to MPEG Surround, SAOC also creates a mono or stereo downmix. In addition, object parameters are calculated and included. At the decoder side, the user may manipulate these parameters to control various features of the individual objects, such as position, level, equalization, or even to apply effects such as reverb. FIG. 3 illustrates an interactive interface that enables the user to control the individual objects contained in an SAOC bitstream. By means of a rendering matrix individual sound objects are mapped onto loudspeaker channels.

SAOC allows a more flexible approach and in particular allows more rendering based adaptability by transmitting audio objects in addition to only reproduction channels. This allows the decoder-side to place the audio objects at arbitrary positions in space, provided that the space is adequately covered by loudspeakers. This way there is no relation between the transmitted audio and the reproduction or rendering setup, hence arbitrary loudspeaker setups can be used. This is advantageous for e.g. home cinema setups in a typical living room, where the loudspeakers are almost never at the intended positions. In SAOC, it is decided at the decoder side where the objects are placed in the sound scene (e.g. by means of an interface as illustrated in FIG. 3), which may not always be desired from an artistic point-of-view. The SAOC standard does provide ways to transmit a default rendering matrix in the bitstream, eliminating the decoder responsibility. However the provided methods rely on either fixed reproduction setups or on unspecified syntax. Thus SAOC does not provide normative means to fully transmit an audio scene independently of the loudspeaker setup. Also, SAOC is not well equipped to the faithful rendering of diffuse signal components. Although there is the possibility to include a so called Multichannel Background Object (MBO) to capture the diffuse sound, this object is tied to one specific loudspeaker configuration.

Another specification for an audio format for 3D audio has been developed by DTS Inc. (Digital Theater Systems). DTS, Inc. has developed Multi-Dimensional Audio (MDA™) an open object-based audio creation and authoring platform to accelerate next-generation content creation. The MDA platform supports both channel and audio objects and adapts to any loudspeaker quantity and configuration. The MDA format allows the transmission of a legacy multichannel downmix along with individual sound objects. In addition, object positioning data is included. The principle of generating an MDA audio stream is illustrated in FIG. 4.

In the MDA approach, the sound objects are received separately in the extension stream and these may be extracted from the multi-channel downmix. The resulting multi-channel downmix is rendered together with the individually available objects.

The objects may consist of so called stems. These stems are basically grouped (downmixed) tracks or objects. Hence, an object may consist of multiple sub-objects packed into a stem. In MDA, a multichannel reference mix can be transmitted with a selection of audio objects. MDA transmits the 3D positional data for each object. The objects can then be extracted using the 3D positional data. Alternatively, the inverse mix-matrix may be transmitted, describing the relation between the objects and the reference mix.

From the MDA description, sound-scene information is likely transmitted by assigning an angle and distance to each object, indicating where the object should be placed relative to e.g. the default forward direction. Thus, positional information is transmitted for each object. This is useful for point-sources but fails to describe wide sources (like e.g. a choir or applause) or diffuse sound fields (such as ambiance). When all point-sources are extracted from the reference mix, an ambient multichannel mix remains. Similar to SAOC, the residual in MDA is fixed to a specific loudspeaker setup.

Thus, both the SAOC and MDA approaches incorporate the transmission of individual audio objects that can be individually manipulated at the decoder side. A difference between the two approaches is that SAOC provides information on the audio objects by providing parameters characterizing the objects relative to the downmix (i.e. such that the audio objects are generated from the downmix at the decoder side) whereas MDA provides audio objects as full and separate audio objects (i.e. that can be generated independently from a downmix at the decoder side). For both approaches, position data may be communicated for the audio objects.

Currently, within ISO/IEC MPEG, a standard MPEG-H 3D Audio is being prepared to facilitate the transport and rendering of 3D audio. MPEG-H 3D Audio is intended to become part of the MPEG-H suite along with HEVC video coding and MMT (MPEG Media Transport) systems layer. FIG. 5 illustrates the current high level block diagram of the intended MPEG 3D Audio system.

In addition to the traditional channel based format, the approach is intended to also support object based and scene based formats. An important aspect of the system is that its quality should scale to transparency for increasing bitrate, i.e. that as the data rate increases the degradation caused by the encoding and decoding should continue to reduce until it is insignificant. However, such a requirement tends to be problematic for parametric coding techniques that have been used quite heavily in the past (viz. MPEG-4 HE-AAC v2, MPEG Surround, MPEG-D SAOC and MPEG-D USAC). In particular, the compensation of information loss for the individual signals tends to not be fully compensated by the parametric data even at very high bit rates. Indeed, the quality will be limited by the intrinsic quality of the parametric model.

MPEG-H 3D Audio furthermore seeks to provide a resulting bitstream which is independent of the reproduction setup. Envisioned reproduction possibilities include flexible loudspeaker setups up to 22.2 channels, as well as virtual surround over headphones and closely spaced loudspeakers.

In summary, the majority of existing sound reproduction systems only allow for a modest amount of flexibility in terms of loudspeaker set-up. Because almost every existing system has been developed from certain basic assumptions regarding either the general configuration of the loudspeakers (e.g. loudspeakers positioned more or less equidistantly around the listener, or loudspeakers arranged on a line in front of the listener, or headphones), or regarding the nature of the content (e.g. consisting of a small number of separate localizable sources, or consisting of a highly diffuse sound scene), every system is only able to deliver an optimal experience for a limited range of loudspeaker configurations that may occur in the rendering environment (such as in a user's home). A new class of sound rendering systems that allow a flexible loudspeaker set-up is therefore desired.

Thus, various activities are currently undertaken in order to develop more flexible audio systems. In particular, audio standardization activity to develop the audio standard known as the ISO/IEC MPEG-H 3D audio standard is undertaken with the aim of providing a single efficient format that delivers immersive audio experiences to consumers for headphones and flexible loudspeaker set-ups.

The activity acknowledges that that most consumers are not able and/or willing (e.g. due to physical limitations of the room) to comply with the standardized loudspeaker set-up requirements of conventional standards. Instead, they place their loudspeakers in their home environment wherever it suits them, which in general results in a sub-optimal sound experience. Given the fact that this is simply the everyday reality, the MPEG-H 3D Audio initiative aims to provide the consumer with an optimal experience given his preferred loudspeaker set-up. Thus, rather than assuming that the loudspeakers are at any specific positions, and thus requiring the user to adapt the loudspeaker setup to the requirements of the audio standard, the initiative seeks to develop an audio system which adapts to any specific loudspeaker configuration that the user has established.

The reference renderer in the MPEG-H 3D Audio Call for Proposals is based on the use of Vector Base Amplitude Panning (VBAP). This is a well-established technology that corrects for deviations from standardized loudspeaker configurations (e.g. 5.1, 7.1 or 22.2) by applying re-panning of sources/channels between pairs of loudspeakers (or triplets in set-ups including loudspeakers at different heights).

VBAP is generally considered to be the reference technology for correcting for non-standard loudspeaker placement due to it offering a reasonable solution in many situations. However, it has also become clear that there are limitations to the deviations of the loudspeaker positions that the technology can effectively handle. For example, since VBAP relies on amplitude panning it does not give very satisfactory results in use-cases with large gaps between loudspeakers, especially between front and rear. Also, it is completely incapable of handling a use-case with surround content and only front loudspeakers. Another specific use-case in which VBAP gives sub-optimal results is when a subset of the available loudspeakers is clustered within a small region, such as e.g. around (or maybe even integrated in) a TV. Accordingly, improved rendering and adaptation approaches would be desirable.

Hence, an improved audio rendering approach would be advantageous and in particular an approach allowing increased flexibility, facilitated implementation and/or operation, allowing a more flexible positioning of loudspeakers, improved adaptation to different loudspeaker configurations and/or improved performance would be advantageous.

SUMMARY OF THE INVENTION

Accordingly, the Invention seeks to preferably mitigate, alleviate or eliminate one or more of the above mentioned disadvantages singly or in any combination. According to an aspect of the invention there is provided an audio apparatus comprising: a receiver for receiving audio data and audio transducer position data for a plurality of audio transducers; a renderer for rendering the audio data by generating audio transducer drive signals for the plurality of audio transducers from the audio data; a clusterer for clustering the plurality of audio transducers into a set of audio transducer clusters in response to the audio transducer position data and distances between audio transducers of the plurality of audio transducers in accordance with a spatial distance metric; and a render controller arranged to adapt the rendering in response to the clustering.

The invention may provide improved rendering in many scenarios. In many practical applications, a substantially improved user experience may be achieved. The approach allows for increased flexibility and freedom in positioning of audio transducers (specifically loudspeakers) used for rendering audio. In many applications and embodiments, the approach may allow the rendering to adapt to the specific audio transducer configuration. Indeed, in many embodiments the approach may allow a user to simply position loudspeakers at desired positions (perhaps associated with an overall guideline, such as to attempt to surround the listening spot), and the system may automatically adapt to the specific configuration.

The approach may provide a high degree of flexibility. Indeed, the clustering approach may provide an ad-hoc adaptation to specific configurations. For example, the approach does not need e.g. predetermined decisions of the size of audio transducers in each cluster. Indeed, in typical embodiments and scenarios, the number of audio transducers in each cluster will be unknown prior to the clustering. Also, the number of audio transducers in each cluster will typically be different for (at least some) different clusters.

Some clusters may comprise only a single audio transducer (e.g. if the single audio transducer is too far from all other audio transducers for the distance to meet a given requirement for clustering).

The clustering may seek to cluster audio transducers having a spatial coherence into the same clusters. Audio transducers in a given cluster may have a given spatial relationship, such as a maximum distance or a maximum neighbor distance.

The render controller may adapt the rendering. The adaptation may be a selection of a rendering algorithm/mode for one or more clusters, and/or may be an adaptation/configuration/modification of a parameter of a rendering algorithm/mode.

The adaptation of the rendering may be in response to an outcome of the clustering, such as an allocation of audio transducers to clusters, the number of clusters, a parameter of audio transducers in a cluster (e.g. maximum distance between all audio transducers or between closest neighbor audio transducers).

The distances between audio transducers (indeed, in some embodiments, all distances including e.g. determinations of closest neighbors etc.) may be determined in accordance with the spatial distance metric.

The spatial distance metric may in many embodiments be a Euclidian or angular distance.

In some embodiments, the spatial distance metric may be a three dimensional spatial distance metric, such as a three dimensional Euclidian distance.

In some embodiments, the spatial distance metric may be a two dimensional spatial distance metric, such as a two dimensional Euclidian distance. For example, the spatial distance metric may be a Euclidian distance of a vector as projected on to a plane. For example, a vector between positions of two loudspeakers may be projected on to a horizontal plane and the distance may be determined as the Euclidian length of the projected vector.

In some embodiments, the spatial distance metric may be a one dimensional spatial distance metric, such as an angular distance (e.g. corresponding to a difference in the angle values of polar representations of two audio transducers).

The audio transducer signals may be drive signals for the audio transducers. The audio transducer signals may be further processed before being fed to the audio transducers, e.g. by filtering or amplification. Equivalently, the audio transducers may be active transducers including functionality for amplifying and/or filtering the provided drive signal. An audio transducer signal may be generated for each audio transducer of the plurality of audio transducers.

The audio transducer position data may provide a position indication for each audio transducer of the set of audio transducers or may provide position indications for only a subset thereof.

The audio data may comprise one or more audio components, such as audio channels, audio objects etc.

The renderer may be arranged to generate, for each audio component, audio transducer signal components for the audio transducers, and to generate the audio transducer signal for each audio transducer by combining the audio transducer signal components for the plurality of audio components.

The approach is highly suitable to audio transducers with a relatively high number of audio transducers. Indeed, in some embodiments, the plurality of audio transducers comprises no less than 10 or even 15 audio transducers.

In some embodiments, the renderer may be capable of rendering the audio data in accordance with a plurality of rendering modes; and the render controller may be arranged to select at least one rendering mode from the plurality of rendering modes in response to the clustering.

The audio data and audio transducer position data may in some embodiments be received together in the same data stream and possibly from the same source. In other embodiments, the data may be independent and indeed may be completely separate data e.g. received in different formats and from different sources. For example, the audio data may be received as an encoded audio data stream from a remote source and the audio transducer position data may be received from a local manual user input. Thus, the receiver may comprise separate (sub)receivers for receiving the audio data and the audio transducer position data. Indeed, the (sub)receivers for receiving the audio data and the audio transducer position data may be implemented in different physical devices.

The audio transducer drive signals may be any signals that allow audio transducers to render the audio represented by the audio transducer drive signals. For example, in some embodiments, the audio transducer drive signals may be analogue power signals that are directly fed to passive audio transducers. In other embodiments, the audio transducer drive signals may e.g. be low power analogue signals that may be amplified by active speakers. In yet other embodiments, the audio transducer drive signals may be digitized signals which may e.g. be converted to analogue signals by the audio transducers. In some embodiments, the audio transducer drive signals may e.g. be encoded audio signals that may e.g. be communicated to audio transducers via a network or e.g. a wireless communication link. In such examples, the audio transducers may comprise decoding functionality.

In accordance with an optional feature of the invention, the renderer is capable of rendering audio components in accordance with a plurality of rendering modes; and the render controller is arranged to independently select rendering modes from the plurality of rendering modes for different audio transducer clusters.

This may provide an improved and efficient adaptation of the rendering in many embodiments. In particular, it may allow advantageous rendering algorithms to be dynamically and ad-hoc allocated to audio transducer subsets that are capable of supporting these rendering algorithms while allowing other algorithms to be applied to subsets that cannot support these rendering algorithms.

The render controller may be arranged to independently select the rendering mode for the different clusters in the sense that different rendering modes are possible selections for the clusters. Specifically, one rendering mode may be selected for a first cluster while a different rendering mode is selected for a different cluster.

The selection of a rendering mode for one cluster may consider characteristics associated with audio transducers belonging to the cluster, but may e.g. in some scenarios also consider characteristics associated with other clusters.

In accordance with an optional feature of the invention, the renderer is capable of performing an array processing rendering; and the render controller is arranged to select an array processing rendering for a first cluster of the set of audio transducer clusters in response to a property of the first cluster meeting a criterion.

This may provide improved performance in many embodiments and/or may allow an improved user experience and/or increased freedom and flexibility. In particular, the approach may allow improved adaptation to the specific rendering scenario.

Array processing may allow a particularly efficient rendering and may in particular allow a high degree of flexibility in rendering audio with desired spatial perceptual characteristics. However, array processing typically requires audio transducers of the array to be close together.

In array processing, an audio signal is rendered by feeding it to a plurality of audio transducers with the phase and amplitude being adjusted between audio transducers to provide a desired radiation pattern. The phase and amplitudes are typically frequency dependent.

Array processing may specifically include beam forming, wave field synthesis, and dipole processing (which may be considered a form of beam forming). Different array processes may have different requirements for the audio transducers of the array and improved performance can in some embodiments be achieved by selecting between different array processing techniques.

In accordance with an optional feature of the invention, the renderer is arranged to perform an array processing rendering; and the render controller is arranged to adapt the array processing rendering for a first cluster of the set of audio transducer clusters in response to a property of the first cluster.

This may provide improved performance in many embodiments and/or may allow an improved user experience and/or increased freedom and flexibility. In particular, the approach may allow improved adaptation to the specific rendering scenario.

Array processing may allow a particularly efficient rendering and may in particular allow a high degree of flexibility in rendering audio with desired perceptual spatial characteristics. However, array processing typically requires audio transducers of the array to be close together.

In accordance with an optional feature of the invention, the property is at least one of a maximum distance between audio transducers of the first cluster being closest neighbors in accordance with the spatial distance metric; a maximum distance between audio transducers of the first cluster in accordance with the spatial distance metric; and a number of audio transducers in the first cluster.

This may provide a particularly advantageous adaptation of the rendering and specifically of the array processing.

In accordance with an optional feature of the invention, the clusterer is arranged to generate a property indication for a first cluster of the set of audio transducer clusters; and the render controller is arranged to adapt the rendering for the first cluster in response to the property indication.

This may provide improved performance in many embodiments and/or may allow an improved user experience and/or increased flexibility. In particular, the approach may allow improved adaptation to the specific rendering scenario.

The adaptation of the rendering may e.g. be by selecting the rendering mode in response to the property. As another example, the adaptation may be by adapting a parameter of a rendering algorithm.

In accordance with an optional feature of the invention, the property indication is indicative of at least one property selected from the group of: a maximum distance between audio transducers of the first cluster being closest neighbors in accordance with the spatial distance metric; and a maximum distance between any two audio transducers of the first cluster.

These parameters may provide particularly advantageous adaption and performance in many embodiments and scenarios. In particular, they may often provide a very strong indication of the suitability of and/or preferred parameters for array processing. In accordance with an optional feature of the invention, the property indication is indicative of at least one property selected from the group of: a frequency response of one or more audio transducers of the first cluster; a frequency range restriction for a rendering mode of the renderer; a number of audio transducers in the first cluster; an orientation of the first cluster relative to at least one of a reference position and a geometric property of the rendering environment; and a spatial size of the first cluster.

These parameters may provide particularly advantageous adaption and performance in many embodiments and scenarios.

In accordance with an optional feature of the invention, the clusterer is arranged to generate the set of audio transducer clusters in response to an iterated inclusion of audio transducers to clusters of a previous iteration, where a first audio transducer is included in a first cluster of the set of audio transducer clusters in response to the first audio transducer meeting a distance criterion with respect to one or more audio transducers of the first cluster.

This may provide a particularly advantageous clustering in many embodiments. In particular, it may allow a "bottom-up" clustering wherein increasingly larger clusters are gradually generated. In many embodiments, advantageous clustering is achieved for relatively low computational resource usage.

The process may be initialized by a set of clusters with each cluster comprising one audio transducer, or may e.g. be initialized with a set of initial clusters of few audio transducers (e.g. meeting a given requirement).

In some embodiments, the distance criterion comprises at least one requirement selected from the group of: the first audio transducer is a closest audio transducer to any audio transducer of the first cluster; the first audio transducer belongs to an audio transducer cluster comprising an audio transducer being a closest audio transducer to any audio transducer of the first cluster; a distance between an audio transducer of the first cluster and the first audio transducer is lower than any other distance between audio transducer pairs comprising audio transducers of different clusters; and a distance between an audio transducer of the first cluster and an audio transducer of a cluster to which the first audio transducer belongs is lower than any other distance between audio transducer pairs comprising audio transducers of different clusters In some embodiments, the clusterer may be arranged to generate the set of audio transducer clusters in response to an initial generation of clusters followed by an iterated division of clusters; each division of clusters being in response to a distance between two audio transducers of a cluster exceeding a threshold.

This may provide a particularly advantageous clustering in many embodiments. In particular, it may allow a "top-down" clustering wherein increasingly smaller clusters are gradually generated from larger clusters. In many embodiments, advantageous clustering is achieved for relatively low computational resource usage.

The process may be initialized by a set of clusters comprising a single cluster containing all clusters, e.g. it may be initialized with a set of initial clusters comprising a large number of audio transducers (e.g. meeting a given requirement).

In accordance with an optional feature of the invention, the clusterer is arranged to generate the set of audio transducer clusters subject to a requirement that in a cluster no two audio transducers being closest neighbors in accordance with the spatial distance metric has a distance exceeding a threshold.

This may provide particularly advantageous performance and operation in many embodiments. For example, it may generate clusters that can be assumed to be suitable for e.g. array processing.

In some embodiments, the clusterer may be arranged to generate the set of audio transducer clusters subject to a requirement that no two loudspeakers in a cluster has a distance exceeding a threshold.

In accordance with an optional feature of the invention, the clusterer is further arranged to receive rendering data indicative of acoustic rendering characteristics of at least some audio transducers of the plurality of audio transducers, and to cluster the plurality of audio transducers into the set of audio transducer clusters in response to the rendering data.

This may provide a clustering which in many embodiments and scenarios may allow an improved adaptation of the rendering. The acoustic rendering characteristics may for example include a frequency range indication, such as frequency bandwidth or center frequency, for one or more audio transducers.

In particular, in some embodiments the clustering may be dependent on a radiation pattern, e.g. represented by the main radiation direction, of the audio transducers.

In accordance with an optional feature of the invention, the clusterer is further arranged to receive rendering algorithm data indicative of characteristics of rendering algorithms that can be performed by the renderer, and to cluster the plurality of audio transducers into the set of audio transducer clusters in response to the rendering algorithm data.

This may provide a clustering which in many embodiments and scenarios may allow an improved adaptation of the rendering. The rendering algorithm data may for example include indications of which rendering algorithms/modes can be supported by the renderer, what restrictions there are for these, etc.

In accordance with an optional feature of the invention, the spatial distance metric is an angular distance metric reflecting an angular difference between audio transducers relative to a reference position or direction.

This may provide improved performance in many embodiments. In particular, it may provide improved correspondence to the suitability of clusters for e.g. array processes. According to an aspect of the invention there is provided a method of audio processing, the method comprising: receiving audio data and audio transducer position data for a plurality of audio transducers; rendering the audio data by generating audio transducer drive signals for the plurality of audio transducers from the audio data; clustering the plurality of audio transducers into a set of audio transducer clusters in response to the audio transducer position data and distances between audio transducers of the plurality of audio transducers in accordance with a spatial distance metric; and adapting the rendering in response to the clustering.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which

FIG. 8 illustrates an example of a clustering for the loudspeaker configuration of FIG. 7;

FIG. 10 illustrates an example of a clustering for the loudspeaker configuration of FIG. 7.

DETAILED DESCRIPTION OF SOME EMBODIMENTS OF THE INVENTION

Figure 1:
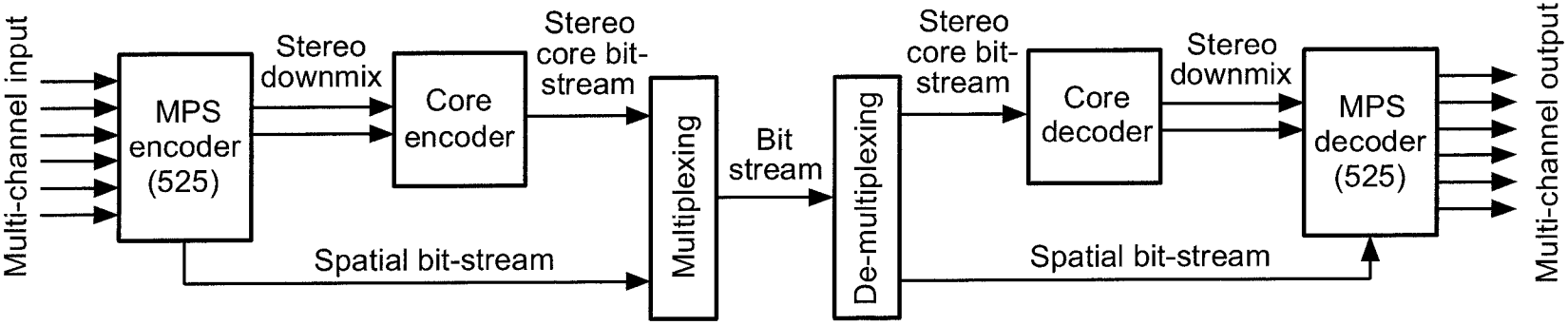
FIG. 1 illustrates an example of the principle of an MPEG Surround system in accordance with prior art.
Figure 2:
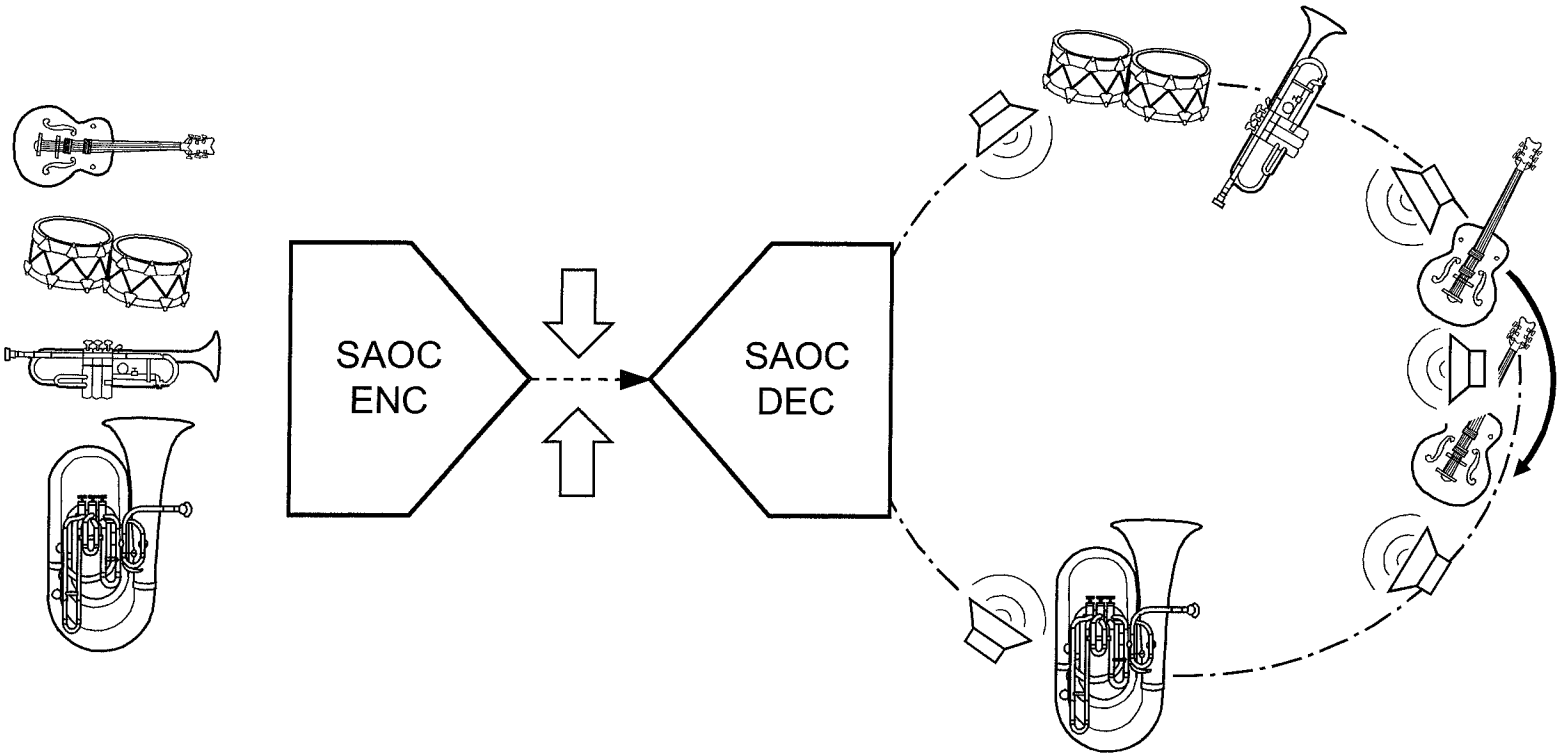
FIG. 2 illustrates an example of elements of an SAOC system in accordance with prior art.
Figure 3:
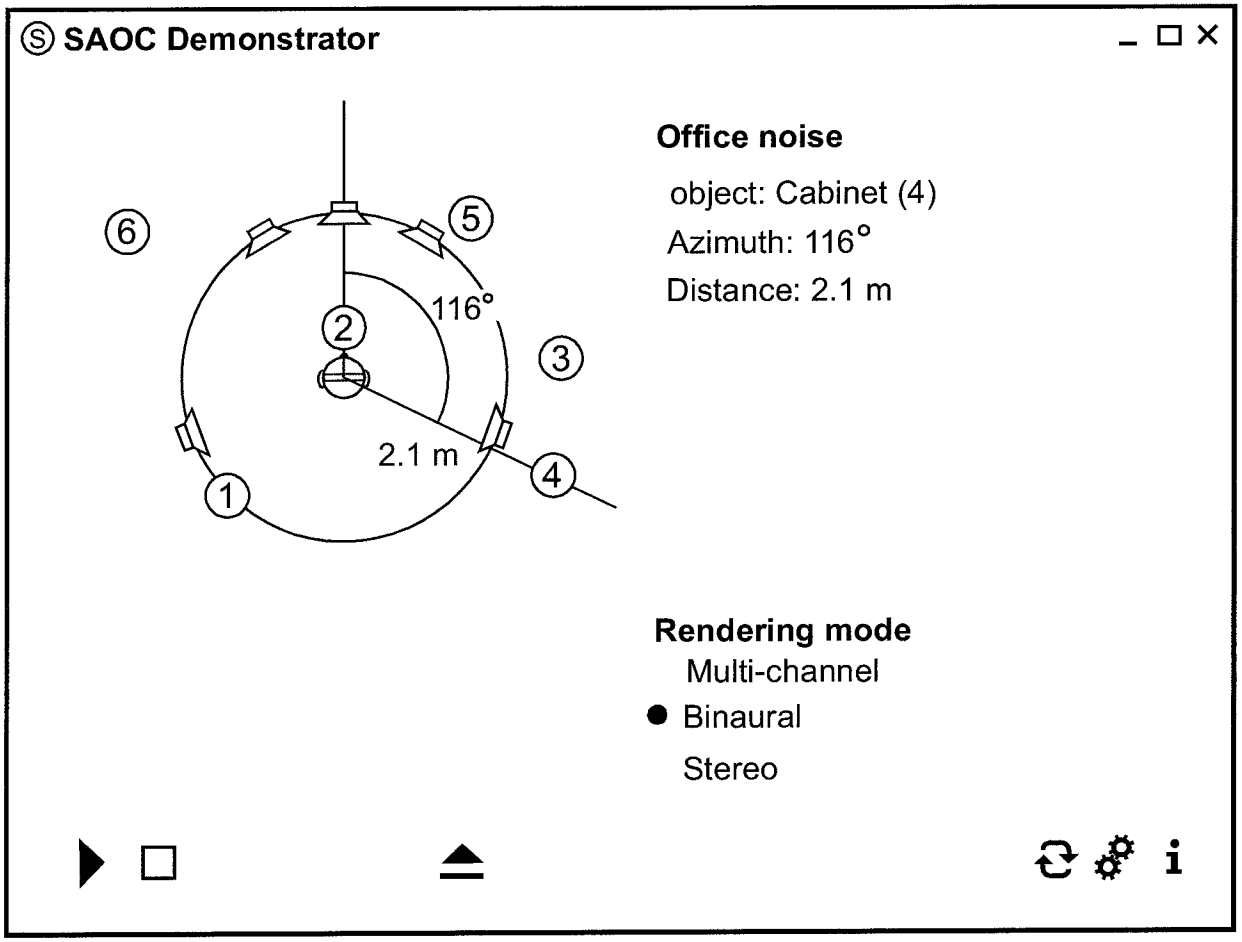
FIG. 3 illustrates an interactive interface that enables the user to control the individual objects contained in a SAOC bitstream.
Figure 4:
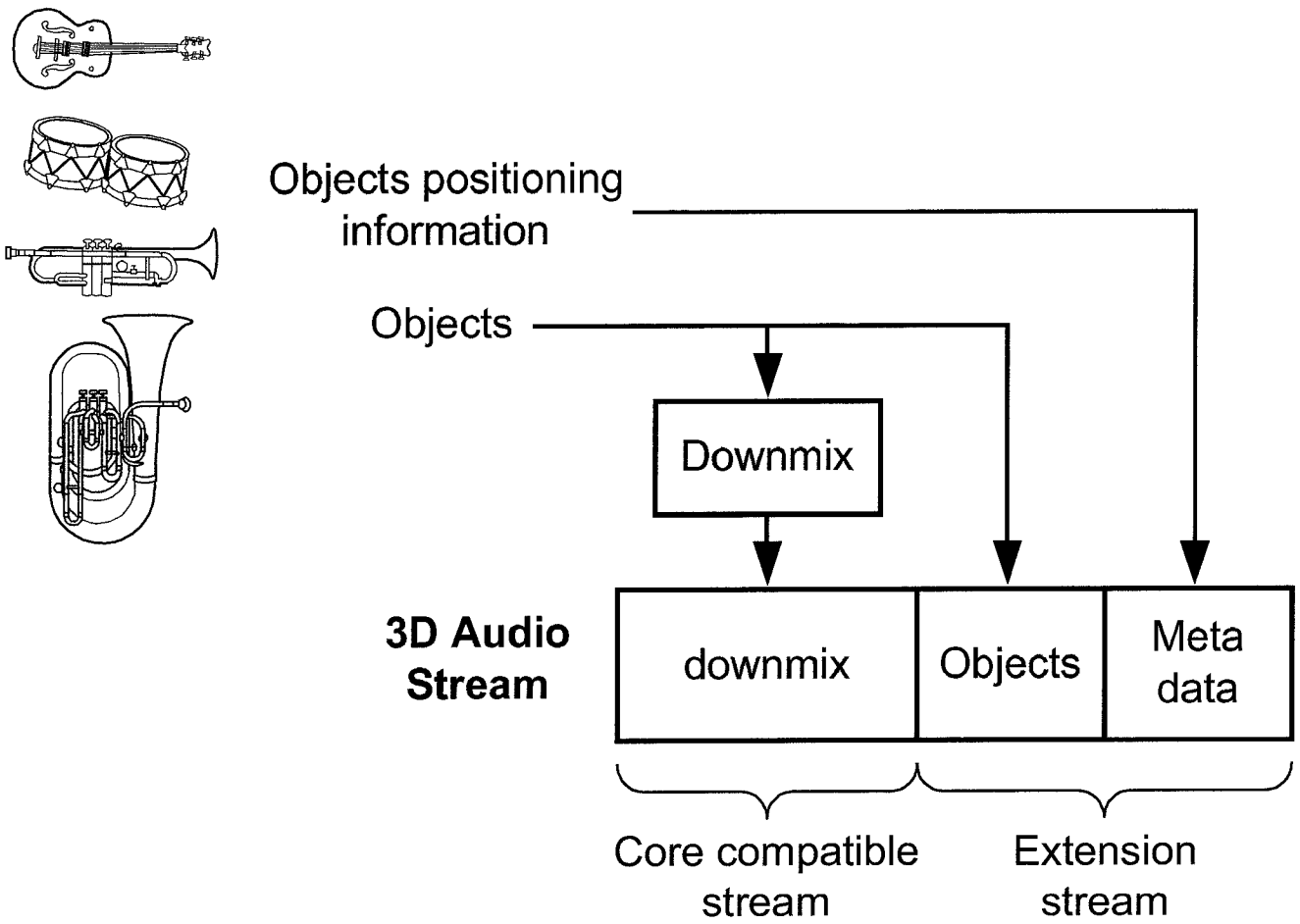
FIG. 4 illustrates an example of the principle of audio encoding of DTS MDA™ in accordance with prior art.
Figure 5:
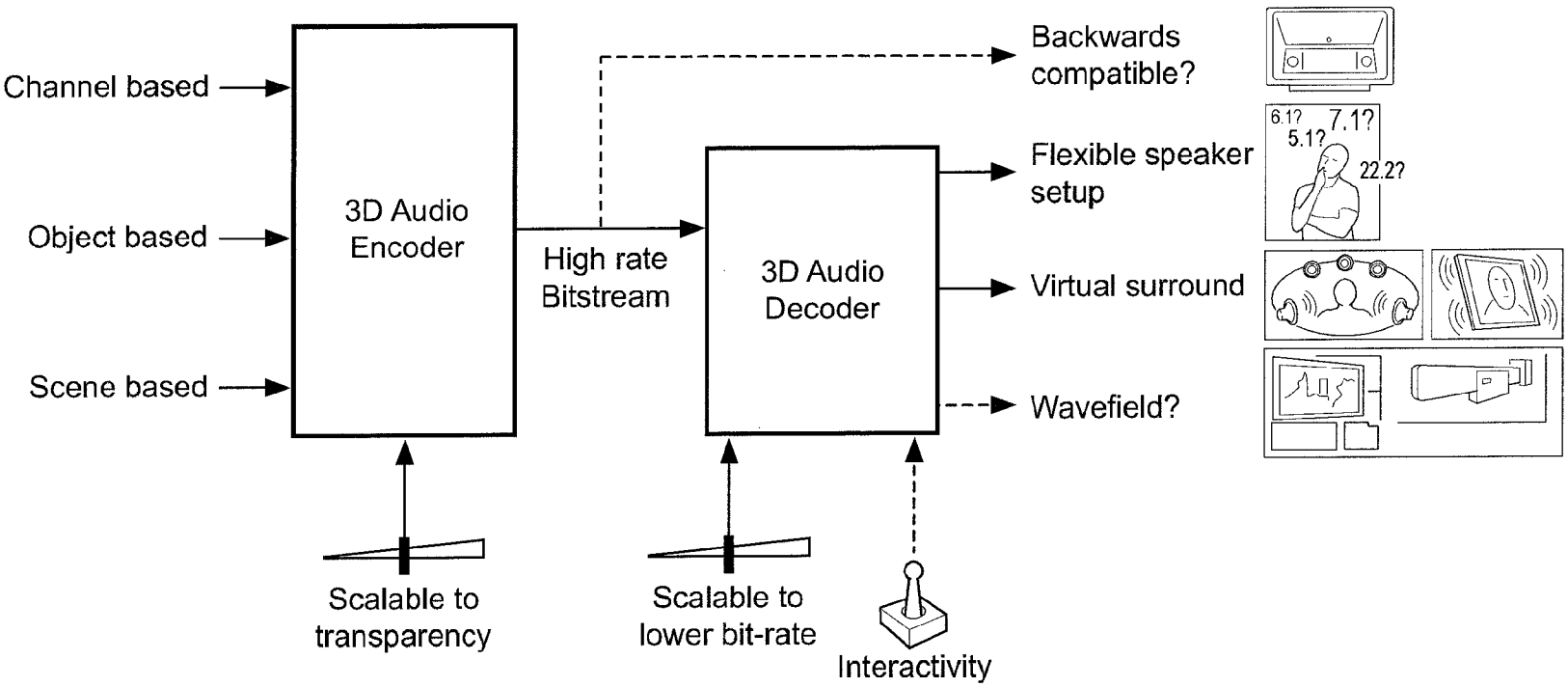
FIG. 5 illustrates an example of elements of an MPEG-H 3D Audio system in accordance with prior art.

The following description focuses on embodiments of the invention applicable to a rendering system arranged to render a plurality of audio components which may be of different types, and in particular to the rendering of audio channels, audio objects and audio scene objects of an MPEG-H 3D audio stream. However, it will be appreciated that the invention is not limited to this application but may be applied to many other audio rendering systems as well as other audio streams.

The described rendering system is an adaptive rendering system capable of adapting its operation to the specific audio transducer rendering configuration used, and specifically to the specific positions of the audio transducers used in the rendering.

The majority of existing sound reproduction systems only allow a very modest amount of flexibility in the loudspeaker set-up. Due to conventional systems generally being developed with basic assumptions regarding either the general configuration of the loudspeakers (e.g. that loudspeakers are positioned more or less equidistantly around the listener, or are arranged on a line in front of the listener etc.) and/or regarding the nature of the audio content (e.g. that it consists of a small number of separate localizable sources, or that it consists of a highly diffuse sound scene etc.), existing systems are typically only able to deliver an optimal experience for a limited range of loudspeaker configurations. This results in a significant reduction in the user experience and in particular in the spatial experience in many real-life use-cases and/or severely reduces the freedom and flexibility for the user to position the loudspeakers.

The rendering system described in the following provides an adaptive rendering system which is capable of delivering a high quality and typically optimized experience for a large range of diverse loudspeaker set-ups. It thus provides the freedom and flexibility sought in many applications, such as for domestic rendering applications.

The rendering system is based on the use of a clustering algorithm which performs a clustering of the loudspeakers into a set of clusters. The clustering is based on the distances between loudspeakers which are determined using a suitable spatial distance metric, such as a Euclidian distance or an angular difference/distance with respect to a reference point. The clustering approach may be applied to any loudspeaker setup and configuration and may provide an adaptive and dynamic generation of clusters that reflect the specific characteristics of the given configuration. The clustering may specifically identify and cluster together loudspeakers that exhibit a spatial coherence. This spatial coherence within individual clusters can then be used by rendering algorithms which are based on an exploitation of spatial coherence. For example, a rendering based on an array processing, such as e.g. a beamforming rendering, can be applied within the identified individual clusters. Thus, the clustering may allow an identification of clusters of loudspeakers that can be used to render audio using a beamforming process.

Accordingly, in the rendering system, the rendering is adapted in dependence on the clustering. Depending on the outcome of the clustering, the rendering system may select one or more parameters of the rendering. Indeed, in many embodiments, a rendering algorithm may be selected freely for each cluster. Thus, the algorithm which is used for a given loudspeaker will depend on the clustering and specifically will depend on the cluster to which the loudspeaker belongs. The rendering system may for example treat each cluster with more than a given number of loudspeakers as a single array of loudspeakers with the audio being rendered from this cluster by an array process, such as a beamforming process.

In some embodiments, the rendering approach is based on a clustering process which may specifically identify one or more subsets out of a total set of loudspeakers, which may have spatial coherence that allows specific rendering algorithms to be applied. Specifically, the clustering may provide a flexible and ad-hoc generation of subsets of loudspeakers in a flexible loudspeaker set-up to which array processing techniques can effectively be applied. The identification of the subsets is based on the spatial distances between neighboring loudspeakers.

In some embodiments, the loudspeaker clusters or subsets may be characterized by one or more indicators that are related to the rendering performance of the subset, and one or more parameters of the rendering may be set accordingly.

For example, for a given cluster, an indicator of the possible array performance of the subset may be generated. Such indicators may include e.g. the maximum spacing between loudspeakers within the subset, the total spatial extent (size) of the subset, the frequency bandwidth within which array processing may effectively be applied to the subset, the position, direction or orientation of the subset relative to some reference position, and indicators that specify for one or more types of array processing whether that processing may effectively be applied to the subset.

Although many different rendering approaches may be used in different embodiments, the approach may specifically in many embodiments be arranged to identify and generate subsets of loudspeakers in any given (random) configuration that are particularly suitable for array processing. The following description will focus on embodiments wherein at least one possible rendering mode uses array processing but it will be appreciated that in other embodiments no array processing may be employed.

Using array processing, the spatial properties of the sound field reproduced by a multi-loudspeaker set-up can be controlled. Different types of array processing exist, but commonly the processing involves sending a common input signal to multiple loudspeakers with individual gain and phase modifications being applied to each loudspeaker signal, possibly in a frequency-dependent way.

The array processing may be designed to:

restrict the spatial region to which sound is radiated (beamforming);

result in a spatial soundfield that is identical to that of a virtual sound source at some desired source location (Wave Field Synthesis and similar techniques);

prevent sound radiation towards a specific direction (dipole processing);

render sound such that it does not convey clear directional association to the listener;

render sound such that it creates a desired spatial experience for a particular position in listening space (loudspeaker auralization using cross-talk cancellation and HRTFs).

It will be appreciated that these are merely some specific examples and that any other audio array processing may alternatively or additionally be used.

The different array processing techniques have different requirements for the loudspeaker array, for example in terms of the maximum allowable spacing between the loudspeakers or the minimum number of loudspeakers in the array. These requirements also depend on the application and use-case. They may be related to the frequency bandwidth within which the array processing is required to be effective, and they may be perceptually motivated. For example, Wave Field Synthesis processing may be effective with an inter-loudspeaker spacing of up to 25 cm and typically requires a relatively long array to have real benefit. Beamforming processing, on the other hand, is typically only useful with smaller inter-loudspeaker spacings (say, less than 10 cm) but can still be effective with relatively short arrays, while dipole processing requires only two loudspeakers that are relatively closely spaced.

Therefore, different subsets of a total set of loudspeakers may be suitable for different types of array processing. The challenge is to identify these different subsets and characterize them such that suitable array processing techniques may be applied to them. In the described rendering system, the subsets are dynamically determined without prior knowledge or assumptions of specific loudspeaker configurations being required. The determination is based on a clustering approach which generates subsets of the loudspeakers dependent on their spatial relationships.

The rendering system may accordingly adapt the operation to the specific loudspeaker configuration and may specifically optimize the use of array processing techniques to provide improved rendering and in particular to provide an improved spatial rendering. Indeed, typically, array processing can when used with suitable loudspeaker arrays provide a substantially improved spatial experience in comparison to e.g. a VBAP approach as used in some rendering systems. The rendering system can automatically identify suitable loudspeaker subsets that can support suitable array processing thereby allowing an improved overall audio rendering.

Figure 6:
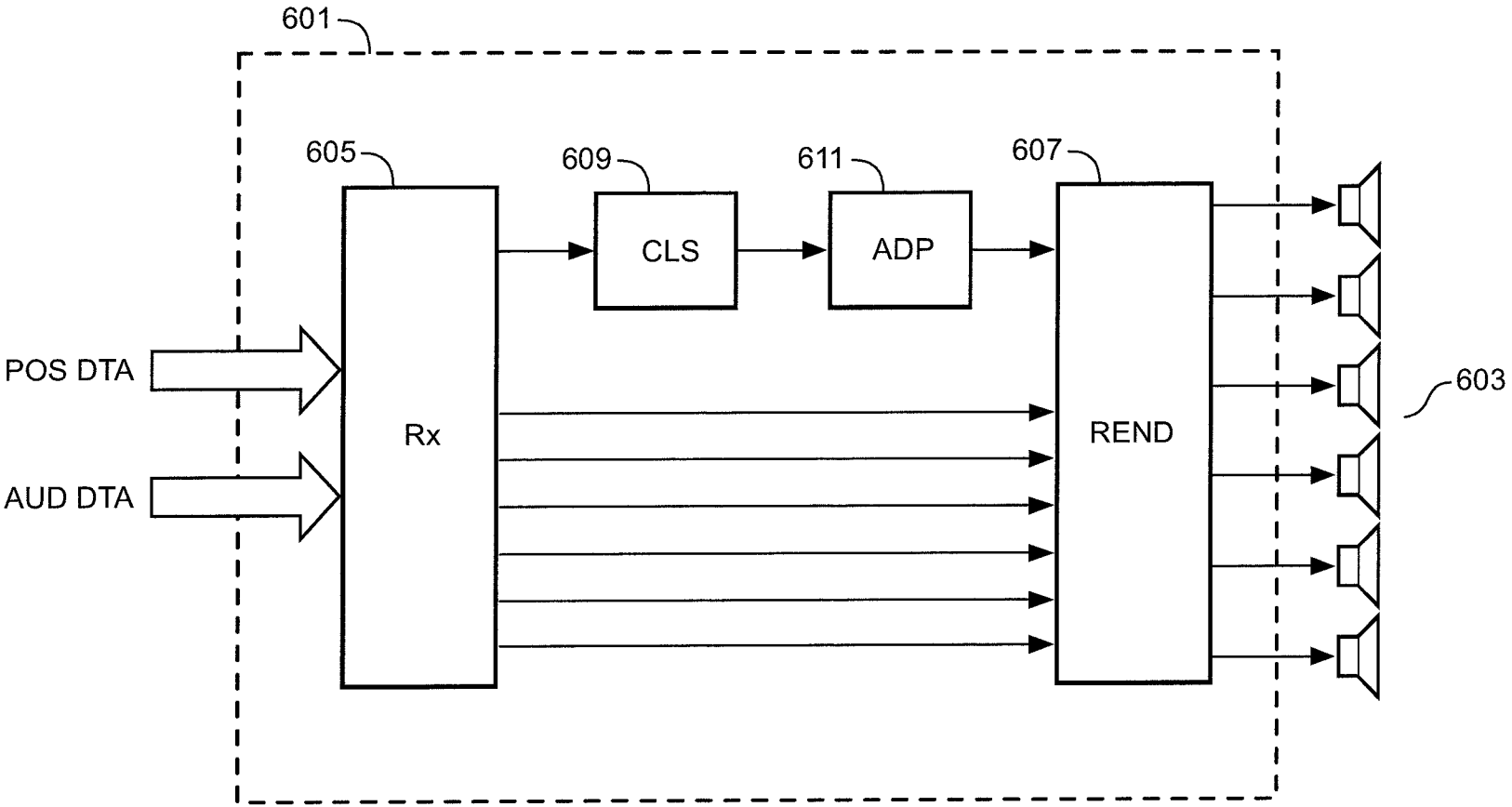
FIG. 6 illustrates an example of an audio apparatus in accordance with some embodiments of the invention.

FIG. 6 illustrates an example of a rendering system/audio apparatus 601 in accordance with some embodiments of the invention.

The audio processing apparatus 601 is specifically an audio renderer which generates drive signals for a set of audio transducers, which in the specific example are loudspeakers 603. Thus, the audio processing apparatus 601 generates audio transducer drive signals that in the specific example are drive signals for a set of loudspeakers 603. FIG. 6 specifically illustrates an example of six loudspeakers but it will be appreciated that this merely illustrates a specific example and that any number of loudspeakers may be used. Indeed, in many embodiments, the total number of loudspeakers may be no less than 10 or even 15 loudspeakers.

The audio processing apparatus 601 comprises a receiver 605 which receives audio data comprising a plurality of audio components that are to be rendered from the loudspeakers 603. The audio components are typically rendered to provide a spatial experience to the user and may for example include audio signals, audio channels, audio objects and/or audio scene objects. In some embodiments, the audio data may represent only a single mono audio signal. In other embodiments, a plurality of audio components of different types may e.g. be represented by the audio data.

The audio processing apparatus 601 further comprises a renderer 607 which is arranged to render (at least part of) the audio data by generating the audio transducer drive signals (henceforth simply referred to as drive signals), i.e. the drive signals for the loudspeakers 603, from the audio data. Thus, when the drive signals are fed to the loudspeakers 603, they produce the audio represented by the audio data.

The renderer may specifically generate drive signal components for the loudspeakers 603 from each of a number of audio components in the received audio data, and then combine the drive signal components for the different audio components into single audio transducer signals, i.e. into the final drive signals that are fed to the loudspeakers 603. For brevity and clarity, FIG. 6 and the following description will not discuss standard signal processing operations that may be applied to the drive signals or when generating the drive signals. However, it will be appreciated that the system may include e.g. filtering and amplification functions.

The receiver 605 may in some embodiments receive encoded audio data which comprises encoded audio data for one or more audio components, and may be arranged to decode the audio data and provide decoded audio streams to the renderer 607. Specifically, one audio stream may be provided for each audio component. Alternatively, one audio stream can be a downmix of multiple sound objects (as for example for a SAOC bitstream).

In some embodiments, the receiver 605 may further be arranged to provide position data to the renderer 607 for the audio components, and the renderer 607 may position the audio components accordingly. In some embodiments, position data may be provided from e.g. a user input, by a separate algorithm, or generated by the rendering system/audio apparatus 601 itself. In general, it will be appreciated that the position data may be generated and provided in any suitable way and in any suitable format.

In contrast to conventional systems, the audio processing apparatus 601 of FIG. 6 does not merely generate the drive signals based on a predetermined or assumed position of the loudspeakers 603. Rather, the system adapts the rendering to the specific configuration of the loudspeakers. The adaptation is based on a clustering of the loudspeakers 603 into a set of audio transducer clusters.

Accordingly, the rendering system comprises a clusterer 609 which is arranged to cluster the plurality of audio transducers into a set of audio transducer clusters. Thus, a plurality of clusters corresponding to subsets of the loudspeakers 603 is produced by the clusterer 609. One or more of the resulting clusters may comprise only a single loudspeaker or may comprise a plurality of loudspeakers 603. The number of loudspeakers in one or more of the clusters is not predetermined but depends on the spatial relationships between the loudspeakers 603.

The clustering is based on the audio transducer position data which is provided to the clusterer 609 from the receiver 605. The clustering is based on spatial distances between the loudspeakers 603 where the spatial distance is determined in accordance with a spatial distance metric. The spatial distance metric may for example be a two- or three dimensional Euclidian distance or may be an angular distance relative to a suitable reference point (e.g. a listening position).

It will be appreciated that the audio transducer position data may be any data providing an indication of a position of one or more of the loudspeakers 603, including absolute or relative positions (including e.g. positions relative to other positions of loudspeakers 603, relative to a listening position, or the position of a separate localization device or other device in the environment). It will also be appreciated that the audio transducer position data may be provided or generated in any suitable way. For example, in some embodiments the audio transducer position data may be entered manually by a user, e.g. as actual positions relative to a reference position (such as a listening position) or as distances and angles between loudspeakers. In other examples, the audio processing apparatus 601 may itself comprise functionality for estimating positions of the loudspeakers 603 based on measurements. For example, the loudspeakers 603 may be provided with microphones and this may be used to estimate positions. E.g. each loudspeaker 603 may in turn render a test signal, and the time differences between the test signal components in the microphone signals may be determined and used to estimate the distances to the loudspeaker 603 rendering the test signal. The complete set of distances obtained from tests for a plurality (and typically all) loudspeakers 603 can then be used to estimate relative positions for the loudspeakers 603.

The clustering will seek to cluster loudspeakers that have a spatial coherence into clusters. Thus, clusters of loudspeakers are generated where the loudspeakers within each cluster meet one or more distance requirements with respect to each other. For example, each cluster may comprise a set of loudspeakers for which each loudspeaker has a distance (in accordance with the distance metric) to at least one other loudspeaker of the cluster which is below a predetermined threshold. In some embodiments, the generation of the cluster may be subject to a requirement that a maximum distance (in accordance with the distance metric) between any two loudspeakers in the cluster is less than a threshold.

The clusterer 609 is arranged to perform the clustering based on the distance metric, the position data and the relative distance requirements for loudspeakers of a cluster. Thus, the clusterer 609 does not assume or require any specific loudspeaker positions or configuration. Rather, any loudspeaker configuration may be clustered based on position data. If a given loudspeaker configuration does indeed comprise a set of loudspeakers positioned with a suitable spatial coherence, the clustering will generate a cluster comprising the set of loudspeaker. At the same time, loudspeakers that are not sufficiently close to any other loudspeakers to exhibit a desired spatial coherence will end up in clusters comprising only the loudspeaker itself.

The clustering may thus provide a very flexible adaptation to any loudspeaker configuration. Indeed, for any given loudspeaker configuration, the clustering may e.g. identify any subset of loudspeakers 603 that are suitable for array processing.

The clusterer 609 is coupled to an adaptor/render controller 611 which is further coupled to the renderer 607. The render controller 611 is arranged to adapt the rendering by the renderer 607 in response to the clustering.

The clusterer 609 thus provides the render controller 611 with data describing the outcome of the clustering. The data may specifically include an indication of which loudspeakers 603 belong to which clusters, i.e. of the resulting clusters and of their constituents. It should be noted that in many embodiments, a loudspeaker may belong to more than one cluster. In addition to the information of which loudspeakers are in each cluster, the clusterer 609 may also generate additional information, such as e.g. indications of the mean or max distance between the loudspeakers in the cluster (e.g. the mean or max distance between each loudspeaker in the cluster and the nearest other loudspeaker of the cluster).

The render controller 611 receives the information from the clusterer 609 and in response it is arranged to control the renderer 607 so as to adapt the rendering to the specific clustering. The adaptation may for example be a selection of a rendering mode/algorithm and/or a configuration of a rendering mode/algorithm, e.g. by a setting of one or more parameters of a rendering mode/algorithm.

For example, the render controller 611 may for a given cluster select a rendering algorithm that is suitable for the cluster. For example, if the cluster comprises only a single loudspeaker, the rendering of some audio components may be by a VBAP algorithm which e.g. uses another loudspeaker belonging to a different cluster. However, if the cluster instead comprises a sufficient number of loudspeakers, the rendering of the audio component may instead be performed using an array processing such as a beamforming or a wave field synthesis. Thus, the approach allows for an automatic detection and clustering of loudspeakers for which array processing techniques can be applied to improve the spatial perception while at the same time allowing other rendering modes to be used when this is not possible.

In some embodiments, the parameters of the rendering mode may be set depending on further characteristics. For example, the actual array processing may be adapted to reflect the specific positions of the loudspeakers in a given cluster used for the array processing rendering.

As another example, a rendering mode/algorithm may be pre-selected and the parameters for the rendering may be set in dependence on the clustering. For example, a beamforming algorithm may be adapted to reflect the number of loudspeakers that are comprised in the given cluster.

Thus, in some embodiments, the render controller 611 is arranged to select between a number of different algorithms depending on the clustering, and it is specifically capable of selecting different rendering algorithms for different clusters.

In particular, the renderer 607 may be operable to render the audio components in accordance with a plurality of rendering modes that have different characteristics. For example, some rendering modes will employ algorithms that provide a rendering which gives a very specific and highly localized audio perception, whereas other rendering modes employ rendering algorithms that provide a diffuse and spread out position perception. Thus, the rendering and perceived spatial experience can differ very substantially depending on which rendering algorithm is used. Also, the different rendering algorithms may have different requirements to the loudspeakers 603 used to render the audio. For example, array processing, such as beamforming or wave field synthesis requires a plurality of loudspeakers that are positioned close together whereas VBAP techniques can be used with loudspeakers that are positioned further apart.

In the specific embodiments, the render controller 611 is arranged to control the render mode used by the renderer 607. Thus, the render controller 611 controls which specific rendering algorithms are used by the renderer 607. The render controller 611 selects the rendering modes based on the clustering, and thus the rendering algorithms employed by the audio processing apparatus 601 will depend on the positions of the loudspeakers 603.

The render controller 611 does not merely adjust the rendering characteristics or switch between the rendering modes for the system as a whole. Rather, the audio processing apparatus 601 of FIG. 6 is arranged to select rendering modes and algorithms for individual loudspeaker clusters. The selection is typically dependent on the specific characteristics of the loudspeakers 603 in the cluster. Thus, one rendering mode may be used for some loudspeakers 603 whereas another rendering mode may at the same time be used for other loudspeakers 603 (in a different cluster). The audio rendered by the system of FIG. 6 is thus in such embodiments a combination of the application of different spatial rendering modes for different subsets of the loudspeakers 603 where the spatial rendering modes are selected dependent on the clustering.

The render controller 611 may specifically independently select the rendering mode for each cluster.

The use of different rendering algorithms for different clusters may provide improved performance in many scenarios and may allow an improved adaptation to the specific rendering setup while in many scenarios providing an improved spatial experience.

In some embodiments, the render controller 611 may be arranged to select different rendering algorithms for different audio components. For example, different algorithms may be selected dependent on the desired position or type of the audio component. For example, if a spatially well-defined audio component is intended to be rendered from a position between two clusters, the render controller 611 may e.g. select a VBAP rendering algorithm using loudspeakers from the different clusters. However, if a more diffuse audio component is rendered, beamforming may be used within one cluster to render the audio component with a beam having a notch in the direction of the listening position thereby attenuating any direct acoustic path.

The approach may be used with a low number of loudspeakers but may in many embodiments be particularly advantageous for systems using a larger number of loudspeakers. The approach may provide benefits even for systems with e.g. a total of four loudspeakers. However, it may also support configurations with a large number of loudspeakers such as e.g. systems with no less than 10 or 15 loudspeakers. For example, the system may allow a use scenario wherein a user is simply asked to position a large number of loudspeakers around the room. The system can then perform a clustering and use this to automatically adapt the rendering to the specific loudspeaker configuration that has resulted from the users positioning of loudspeakers.

Different clustering algorithms may be used in different embodiments. In the following, some specific examples of suitable clustering algorithms will be described. The clustering is based on spatial distances between loudspeakers measured in accordance with a suitable spatial distance metric. This may specifically be a Euclidian distance (typically a two- or three-dimensional distance) or an angular distance. The clustering seeks to cluster loudspeakers that have a spatial relationship which meets a set of requirements for distances between the loudspeakers of the cluster. The requirements may typically for each loudspeaker include (or consist of) a requirement that a distance to at least one other loudspeaker of the cluster is less than a threshold.

In general, many different strategies and algorithms exist for clustering data sets into subsets. Depending on the context and the goals of the clustering, some clustering strategies and algorithms are more suitable than others.

In the described system where array processing is used, the clustering is based upon the spatial distances between the loudspeakers in the set-up, since the spatial distance between loudspeakers in an array is the principle parameter in determining the efficacy of any type of array processing. More specifically, the clusterer 609 seeks to identify clusters of loudspeakers that satisfy a certain requirement on the maximum spacing that occurs between the loudspeakers within the cluster.

Typically, the clustering comprises a number of iterations wherein the set of clusters are modified.

Specifically, the class of clustering strategies known as "hierarchical clustering" (or: "connectivity-based clustering") are often advantageous. In such clustering methods, a cluster is essentially defined by the maximum distance needed to connect elements within the cluster.

The main characteristic of hierarchical clustering is that when clustering is carried out for different maximum distances, the outcome is a hierarchy, or tree-structure, of clusters, in which larger clusters contain smaller subclusters, which in turn contain even smaller sub-subclusters.

Within the class of hierarchical clustering two different approaches for carrying out the clustering can be distinguished:

Agglomerative or "bottom-up" clustering, in which smaller clusters are merged into larger ones that may e.g. satisfy a looser maximum distance criterion than the individual smaller clusters, Divisive or "top-down" clustering, in which a larger cluster is broken down into smaller clusters that may satisfy more stringent maximum distance requirements than the larger cluster.

It will be appreciated that other clustering methods and algorithms than the ones described herein may be used without detracting from the invention. For example the "Nearest-neighbor chain" algorithm, or the "Density-based clustering" method may be used in some embodiments.

First clustering approaches will be described that use an iterative approach wherein the clusterer 609 seeks to grow one or more of the clusters in each iteration, i.e. a bottom-up clustering method will be described. In this example, the clustering is based on an iterated inclusion of audio transducers to clusters of a previous iteration. In some embodiments, only one cluster is considered in each iteration. In other embodiments, a plurality of clusters may be considered in each iteration. In the approach, an additional loudspeaker may be included in a given cluster if the loudspeaker meets a suitable distance criterion for one or more loudspeakers in the cluster. Specifically, a loudspeaker may be included in a given cluster if the distance to a loudspeaker in the given cluster is below a threshold. In some embodiments, the threshold may be a fixed value, and thus the loudspeaker is included if it is closer than a predetermined value to a loudspeaker of the cluster. In other embodiments, the threshold may be variable and e.g. relative to distances to other loudspeakers. For example, the loudspeaker may be included if it is below a fixed threshold corresponding to the maximum acceptable distance and below a threshold ensuring that the loudspeaker is indeed the closest loudspeaker to the cluster.

In some embodiments, the clusterer 609 may be arranged to merge a first and second cluster if a loudspeaker of the second cluster has been found to be suitable for inclusion into the first cluster.

Figure 7:
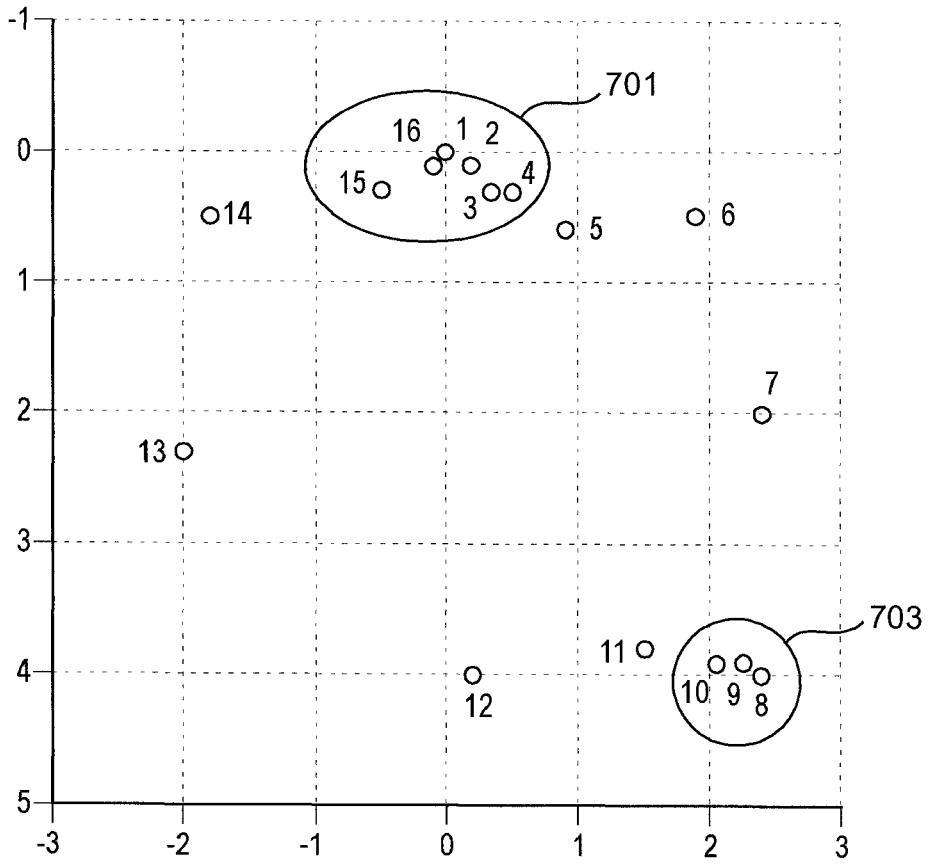
FIG. 7 illustrates an example of a loudspeaker configuration in accordance with some embodiments of the invention.

To describe an example clustering approach, the example set-up of FIG. 7 may be considered. The set-up consists of 16 loudspeakers of which the spatial positions are assumed to be known, i.e. for which audio transducer position data has been provided to the clusterer 609.

The clustering starts by first identifying all nearest-neighbor pairs, i.e. for each loudspeaker the loudspeaker that is closest to it is found. At this point, it should be noted that "distance" may be defined in different ways in different embodiments, i.e. different spatial distance metrics may be used. For ease of description, it will be assumed that the spatial distance metric is a "Euclidian distance", i.e. the most common definition of the distance between two points in space.

The pairs that are now found are the lowest-level clusters or subsets for this set-up, i.e. they form the lowest branches in the hierarchical tree-structure of clusters. We may in this first step impose an additional requirement that a pair of loudspeakers is only considered as a "cluster" if their inter-loudspeaker distance (spacing) is below a certain value $D_{max}$. This value may be chosen in relation to the application. For example, if the goal is to identify clusters of loudspeakers that may be used for array processing, we may exclude pairs in which the two loudspeakers are separated by more than e.g. 50 cm, since we know that no useful array processing is possible beyond such an inter-loudspeaker spacing. Using this upper limit of 50 cm, we find the pairs listed in the first column of the table of FIG. 8. Also listed for each pair is the corresponding spacing $\delta_{max}$.

In the next iteration, the nearest neighbor is found for each of the clusters that were found in the first step, and this nearest neighbor is added to the cluster. The nearest neighbor in this case is defined as the loudspeaker outside the cluster that has the shortest distance to any of the loudspeakers within the cluster (this is known as "minimum"-, "single-linkage" or "nearest neighbor" clustering) with the distance being determined in accordance with the distance metric.

So, for each cluster we find the loudspeaker j outside the cluster (which we label A) for which:

$$\min\{d(i,j):i\epsilon A\}$$

has the smallest value of all loudspeakers outside A, in which d(i,j) is the used distance metric between the positions of loudspeakers i and j.

Thus, in this example, the requirement for including a first loudspeaker in a first cluster requires that the first loudspeaker is a closest loudspeaker to any loudspeaker of the first cluster.

Also in this iteration, we may exclude nearest neighbors that are further than $D_{max}$ away from all loudspeakers in the cluster, to prevent adding loudspeakers to a cluster that are too far away. Thus, the inclusion may be subject to a requirement that the distance does not exceed a given threshold.

The method as described above results in clusters that grow by a single element (loudspeaker) at a time.

Merging (or "linking") of clusters may be allowed to occur, according to some merging (or "linkage") rule that may depend on the application.

For example, in the example using a loudspeaker array processing, if the identified nearest neighbor of a cluster A is already part of another cluster B then it makes sense that the two clusters are merged into a single one, since this results in a larger loudspeaker array and thus a more effective array processing than if only the nearest neighbor is added to cluster A (note that the distance between clusters A and B is always at least equal to the maximum spacing within both clusters A and B, so that merging clusters A and B does not increase the maximum spacing in the resulting cluster any more than adding only the nearest neighbor to cluster A would. So, there can be no adverse effect of merging clusters in the sense of resulting in a larger maximum spacing within the merged cluster than if only the nearest neighbor would be added).

Thus, in some embodiments, the requirement for including a first loudspeaker in a first cluster requires that the first loudspeaker belongs to a cluster comprising a loudspeaker being a closest loudspeaker to any loudspeaker of the first cluster;

Note that variations to the merging rule are possible, for example depending on the application requirements.

The resulting clusters of this second clustering iteration (with merging rule as described above) are listed in the second column of the table of FIG. 8, along with their corresponding maximum spacing $\delta_{max}$.

The iteration is repeated until no new higher-level clusters can be found, after which the clustering is complete.

The table of FIG. 8 lists all clusters that are identified for the example set-up of FIG. 7.

We see that in total ten clusters have been identified. At the highest clustering level there are two clusters: one consisting of six loudspeakers (1, 2, 3, 4, 15 and 16, indicated by ellipsoid 701 in FIG. 7, resulting after four clustering steps), and one consisting of three loudspeakers (8, 9 and 10, indicated by the ellipsoid 703 in FIG. 7, resulting after two clustering iterations). There are six lowest-level clusters consisting of two loudspeakers. Note that in iteration 3, in accordance with the merging rule described above, two clusters ((1, 2, 16) and (3, 4)) are merged that have no loudspeakers in common. All other merges involve a two-loudspeaker cluster of which one loudspeaker already belongs to the other cluster, so that effectively only the other loudspeaker of the two-loudspeaker cluster is added to the other cluster.

For each cluster, the table of FIG. 8 also lists the largest inter-loudspeaker spacing $\delta_{max}$ that occurs within the cluster. In the bottom-up approach, $\delta_{max}$ can be defined for each cluster as the maximum of the values of $\delta_{max}$ for all constituent clusters from the previous clustering step, and the distance between the two loudspeakers where the merge took place in the present clustering step. Thus, for every cluster, the value of $\delta_{max}$ is always equal to or larger than the values of $\delta_{max}$ of its sub-clusters. In other words, in consecutive iterations the clusters grow from smaller clusters into larger clusters with a maximum spacing that increases monotonously.

In an alternative version of the bottom-up embodiment described above, in each clustering iteration only the two nearest-neighbors (clusters and/or individual loudspeakers) in the set are found and merged. Thus, in the first iteration, with all individual loudspeakers still in a separate cluster, we start by finding the two loudspeakers with the smallest distance between them, and link them together to form a two-loudspeaker cluster. Then, the procedure is repeated, finding and linking the nearest-neighbor pair (clusters and/or individual loudspeakers), and so on. This procedure may be carried out until all loudspeakers are merged into a single cluster, or it may be terminated once the nearest-neighbor distance exceeds a certain limit, for example 50 cm.

Thus, in this example, the requirement for including a first loudspeaker into a first cluster requires that a distance between a loudspeaker of the first cluster and the first loudspeaker is lower than any other distance between loudspeaker pairs comprising loudspeakers of different clusters; or that a distance between a loudspeaker of the first cluster and a loudspeaker of a cluster to which the first loudspeaker belongs is lower than any other distance between loudspeaker pairs comprising loudspeakers of different clusters.

For the example of FIG. 7, the specific approach results in the following clustering steps:

1+16→(1, 16); 3+4→(3, 4); 8+9→(8, 9); (8, 9)+10→(8, 9, 10); (1, 16)+2→(1, 2, 16); (1, 2, 16)+(3, 4)→(1, 2, 3, 4, 16); (1, 2, 3, 4, 16)+15→(1, 2, 3, 4, 15, 16).

Accordingly, we see that the clusters resulting from this procedure, indicated in bold in the table of FIG. 8, form a subset of the clusters that were found using the first clustering example. This is because in the first example, loudspeakers can be a member of multiple clusters that do not have a hierarchical relationship, whereas in the second example the cluster membership is exclusive.

In some embodiments, a complete clustering hierarchy such as is as obtained from the bottom-up approaches described above may not be required. Instead, it may be sufficient to identify clusters that satisfy one or more specific requirements on maximum spacing. For example, we may want to identify all highest-level clusters that have a maximum spacing of a given threshold $D_{max}$ (e.g. equal to 50 cm) e.g. because this is considered the maximum spacing for which a specific rendering algorithm can be applied effectively.

This may be achieved as follows:

Starting with one of the loudspeakers, say loudspeaker 1, all loudspeakers are found that have a distance to this loudspeaker 1 that is less than the maximum allowed value $D_{max}$.

Loudspeakers with a larger distance are considered to be spaced too far apart from loudspeaker 1 to be used effectively together with it, using any of the rendering processing methods under consideration. The maximum value could be set to e.g. 25 or 50 cm, depending on which types of e.g. array processing are considered. The resulting cluster of loudspeakers is the first iteration in constructing the largest subset of which loudspeaker 1 is a member and that fulfils the maximum spacing criterion.

Then, the same procedure is carried out for the loudspeakers (if any) that are now in loudspeaker 1's cluster. The loudspeakers that are found now, excluding those that were already part of the cluster, are added to the cluster. This step is repeated for the newly added loudspeakers until no additional loudspeakers are found. At this point, the largest cluster to which loudspeaker 1 belongs, and that fulfils the maximum spacing criterion, has been identified.

Applying this procedure to the set-up of FIG. 7 with $D_{max}$=0.5 m and starting with loudspeaker 1, again results in the cluster indicated by ellipsoid 701, containing the loudspeakers 1, 2, 3, 4, 15 and 16. In this procedure, this cluster/subset is constructed in only two iterations: after the first round, the subset contains loudspeakers 1, 2, 3 and 16, all being separated by less than $D_{max}$ from loudspeaker 1. In the second iteration loudspeakers 4 and 15 are added, being separated by less than $D_{max}$ from both loudspeakers 2 and 3, and loudspeaker 16, respectively. In the next iteration no further loudspeaker are added so the clustering is terminated.

In consecutive iterations, other clusters not overlapping with any of the previously found subsets are identified in the same way. In each iteration, only loudspeakers need to be considered that were not yet identified as being part of any of the previously identified subsets.

At the end of this procedure, all largest clusters have been identified in which all nearest-neighbors have an inter-loudspeaker distance of at most $D_{max}$.

For the example set-up of FIG. 7 only one additional cluster is found, indicated again by ellipsoid 703 and containing the loudspeakers 8, 9 and 10.

To find all clusters that fulfil a different requirement on the maximum spacing $D_{max}$, the procedure outlined above can simply be carried out again with this new value of $D_{max}$. Note that if the new $D_{max}$ is smaller than the previous one, the clusters that will be found now are always sub-clusters of the clusters found with the larger value of $D_{max}$. This means that if the procedure is to be carried out for multiple values of $D_{max}$, it is efficient to start with the largest value and decrease the value monotonously, since then every next evaluation only needs to be applied to the clusters that resulted from the previous one.

For example, if a value of $D_{max}$=0.25 m instead of 0.5 m is used for the set-up of FIG. 7, two sub-clusters are found. The first one is the original cluster containing loudspeaker 1 minus loudspeaker 15, while the second one still contains loudspeakers 8, 9 and 10. If $D_{max}$ is decreased further to 0.15 m, only a single cluster is found, containing loudspeakers 1 and 16.

In some embodiments, the clusterer 609 may be arranged to generate the set of clusters in response to an initial generation of clusters followed by an iterated division of clusters; each division of clusters being in response to a distance between two audio transducers of a cluster exceeding a threshold. Thus, in some embodiments a top-down clustering may be considered.

Top-down clustering can be considered to work the opposite way of bottom-up clustering. It may start by putting all loudspeakers in a single cluster, and then splitting the cluster in recursive iterations into smaller clusters. Each split may be made such that the spatial distance metric between the two resulting new clusters is maximized. This may be quite laborious to implement for multi-dimensional configurations with more than a few elements (loudspeakers), as especially in the initial phase of the process the number of possible splits that have to be evaluated may be very large. Therefore, in some embodiments, such a clustering method may be used in combination with a pre-clustering step.

The clustering approach previously described may be used to generate an initial clustering that can serve as highest-level starting point for a top-down clustering procedure. So, rather than starting with all loudspeakers in a single initial cluster, we could first use a low complexity clustering procedure to identify the largest clusters that satisfy the loosest spacing requirement that is considered useful (e.g. a maximum spacing of 50 cm), and then carry out a top-down clustering procedure on these clusters, breaking down each cluster into smaller ones in consecutive iterations until arriving at the smallest possible (two-loudspeaker) clusters. This prevents that the first steps in the top-down clustering result in clusters that are not useful due to a too large maximum spacing. As argued before, these first top-down clustering steps that are now avoided are also the most computationally demanding, since many clustering possibilities need to be evaluated, so removing the need to actually carry them out may improve the efficiency of the procedure significantly.

In each iteration of the top-down procedure, a cluster is split at the position of the largest spacing that occurs within the cluster. The rationale for this is that this largest spacing is the limiting factor that determines the maximum frequency for which array processing can effectively be applied to the cluster. Splitting the cluster at this largest spacing results in two new clusters that each have a smaller largest spacing, and thus a higher maximum effective frequency, than the parent cluster. Clusters can be split further into smaller clusters with monotonously decreasing maximum spacing until a cluster consisting of only two loudspeakers remains.

Although it is trivial to find the position where a cluster should be split in the case of a one-dimensional set (linear array), this is not the case for 2D- or 3D configurations, since there are many possible ways to split a cluster into two sub-clusters. In principle, however, it is possible to consider all possible splits into two sub-clusters, and find the one that results in the largest spacing between them. This spacing between two clusters may be defined as the smallest distance between any pair of loudspeakers with one loudspeaker being a member of one sub-cluster, and the other loudspeaker being a member of the other sub-cluster.

Accordingly, for each possible split into sub-clusters A and B, we can determine the value of:

$$\min\{d(i,j):i\epsilon A,j\epsilon B\}$$

The split is made such that this value is maximized.

As an example, consider the cluster of the set-up in FIG. 7 indicated by ellipsoid 701, containing loudspeakers 1, 2, 3, 4, 15 and 16. The largest spacing (0.45 m) in this cluster is found between the cluster consisting of loudspeakers 1, 2, 3, 4 and 16, and the cluster consisting of only loudspeaker 15. Therefore, the first split results in the removal of loudspeaker 15 from the cluster. In the new cluster, the largest spacing (0.25 m) is found between the cluster consisting of loudspeakers 1, 2 and 16, and the cluster consisting of loudspeakers 3 and 4, so the cluster is split into these two smaller cluster. A final split can be done for the remaining three-loudspeaker cluster, in which the largest spacing (0.22 m) is found between the cluster consisting of loudspeakers 1 and 16, and the cluster consisting of only loudspeaker 2. So, in the final split loudspeaker 2 is removed, and a final cluster consisting of loudspeakers 1 and 16 remains.

Applying the same procedure to the cluster indicated by ellipsoid 703 in FIG. 7 results in a split between the cluster consisting of loudspeakers 8 and 9, and the cluster consisting of only loudspeaker 10.

In the system, all distances are determined in accordance with a suitable distance metric.

In the clustering examples described above, the distance metric was Euclidian spatial distance between loudspeakers, which tends to be the most common way to define the distance between two points in space.

However, the clustering may also be performed using other metrics for the spatial distance. Depending on the specific requirements and preferences of the individual application, one definition of the distance metric may be more suitable than another. A few examples of different use-cases and corresponding possible spatial distance metrics will be described in the following.

Firstly, the Euclidian distance between two points i and j may be defined as:

$$d_{i,j} = \sqrt{\sum_{n=1}^{N} (i_n - j_n)^2},$$

where $i_n$, $j_n$ represent the coordinates of point i and j respectively in dimension n and N is the number of dimensions.

The metric represents the most common way of defining a spatial distance between two points in space. Using the Euclidian distance as the distance metric means that we determine the distances between the loudspeakers without considering their orientation relative to each other, to others, or to some reference position (e.g. a preferred listening position). For a set of loudspeakers that are distributed arbitrarily in space, this means that we are determining both the clusters and their characteristics (e.g. useable frequency range or suitable processing type) in a way that has no relation to any specific direction of observation. Accordingly, the characteristics in this case reflect certain properties of the array itself, independent of its context. This may be useful in some applications, but it is not the preferred approach in many use cases.

In some embodiments, an angular or "projected" distance metric relative to a listening position may be used.

The performance limits of a loudspeaker array are essentially determined by the maximum spacing within, and the total spatial extent (size) of the array. However, since the apparent or effective maximum spacing and size of the array depends on the direction from which the array is observed, and since we are in general mainly interested in the performance of the array relative to a certain region or direction, it makes sense in many use cases to use a distance metric that takes this region, direction, or point of observation into account.

Specifically, in many use cases a reference or preferred listening position can be defined. In such a case, we would like to determine clusters of loudspeakers that are suitable to achieve a certain sound experience at this listening position, and the clustering and characterization of the clusters should therefore be related to this listening position.

One way to do this is to define the position of each loudspeaker in terms of its angle $\phi$ relative to the listening position, and to define the distance between two loudspeakers by the absolute difference between their respective angles:

$$d_{ij}=|\phi_i-\phi_j|,$$

or alternatively, in terms of the cosine between the position vectors of points i and j:

$$d_{ij} = \frac{\vec{i}\cdot\vec{j}}{\|\vec{i}\|\,\|\vec{j}\|}.$$

This is known as an angular- or cosine similarity distance metric. If the clustering is carried out using this distance metric, loudspeakers that are located on the same line as seen from the listening position (so in front or behind of each other) are considered to be co-located.

The maximum spacing that occurs in a subset is now easy to determine, as it is essentially reduced to a one-dimensional problem.

As in the case of the Euclidian distance metric, the clustering may be restricted to loudspeakers that are less than a certain maximum distance $D_{max}$ away from each other. This $D_{max}$ may be defined directly in terms of a maximum angle difference. However, since important performance characteristics of a loudspeaker array (e.g. its useable frequency range) are related to the physical distance between the loudspeakers (through its relation with the wavelength of the reproduced sound), it is often preferable to use a $D_{max}$ expressed in physical meters, like in the case of the Euclidian distance metric. To take account for the fact that the performance depends on the direction of observation relative to the array, a projected distance between loudspeakers may be used rather than the direct Euclidian distance between them. Specifically, the distance between two loudspeakers may be defined as the distance in the direction orthogonal to the bisector of the angle between the two loudspeakers (as seen from the listening position).

Figure 9:
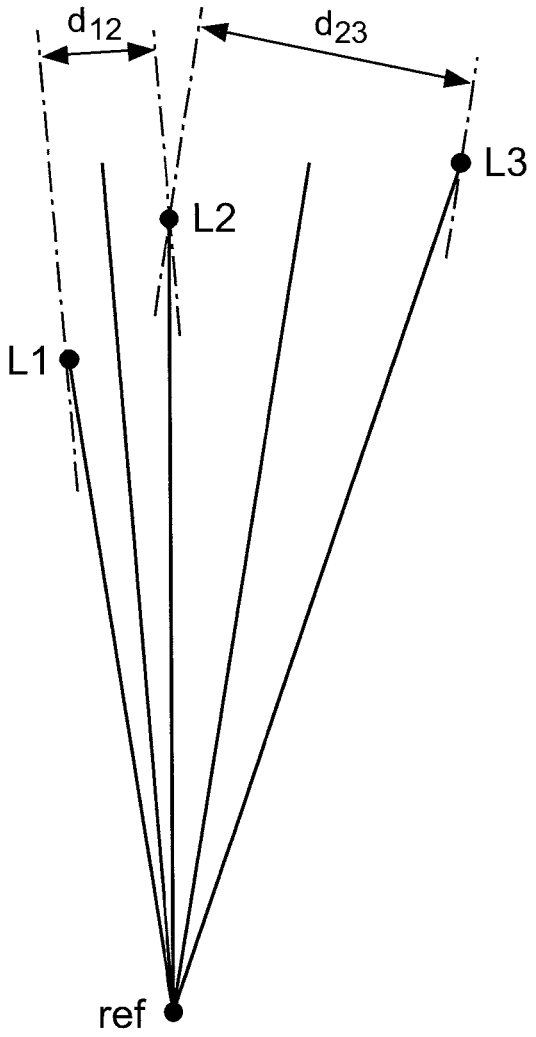
FIG. 9 illustrates an example of a loudspeaker configuration in accordance with some embodiments of the invention.

This is illustrated in FIG. 9 for a 3-loudspeaker cluster. The distance metric is given by:

$$d_{ij} = (r_i + r_j)\sin\left(\frac{1}{2}|\varphi_i - \varphi_j|\right),$$

where $r_i$ and $r_j$ are the radial distances from the reference position to loudspeaker i and j, respectively. It should be noted that the projected distance metric is a form of angular distance.

Note that if all loudspeakers in a cluster are sufficiently close to each other, or if the listening position is sufficiently far away from the cluster, the bisectors between all pairs in the cluster become parallel and the distance definition is consistent within the cluster.

In characterizing the identified clusters, the projected distances can be used for determining the maximum spacing $\delta_{max}$ and size L of the cluster. This will then also be reflected in the determined effective frequency range and may also change the decisions about which array processing techniques can be effectively applied to the cluster.

If a clustering procedure according to the previously described bottom-up approach is applied to the set-up of FIG. 7 with angular distance metric, reference position at (0, 2) and a maximum projected distance $D_{max}$ between the loudspeakers of 50 cm, this results in the following sequence of clustering steps:

8+9→(8, 9); 1+16→(1, 16); (8, 9)+10→(8, 9, 10); 3+4→(3, 4); (3, 4)+2→(2, 3, 4); (1, 16)+(2, 3, 4)→(1, 2, 3, 4, 16); (8, 9, 10)+11→(8, 9, 10, 11); (1, 2, 3, 4, 16)+15→(1, 2, 3, 4, 15, 16);(1, 2, 3, 4, 15, 16)+5→(1, 2, 3, 4, 5, 15, 16).

We see that in this case, the order of clustering is somewhat different from the example with the Euclidian distance metric, and also we find one additional cluster that fulfils the maximum distance criterion. This is because we are now looking at projected distances that are always equal to or smaller than the Euclidian distance. FIG. 10 provides a table listing the clusters and their corresponding characteristics.

In the rendering processing that will eventually be applied to the identified clusters, any differences in the radial distances of loudspeakers within a cluster may be compensated by means of delays.

Note that although the clustering result with this angular distance metric is quite similar to what was obtained with the Euclidian distance metric, this is only because in this example the loudspeakers are distributed more or less in a circle around the reference position. In the more general case, the clustering results can be very different for the different distance metrics.

Since the angular distance metric is one-dimensional, the clustering is in this case essentially one-dimensional, and will therefore be substantially less computationally demanding. Indeed, in practice, a top-down clustering procedure is in this case typically feasible, because the definition of nearest neighbor is completely unambiguous in this case and the number of possible clusterings to evaluate is therefore limited.

In a use case in which there is not just a single preferred listening position but an extended listening area in which the sound experience should be optimized, the embodiment with the angular- or projected distance metric may still be used. In this case, one may perform the clustering and characterization of identified clusters separately for each position in the listening area, or for the extreme positions of the listening area only (for example the four corners in the case of a rectangular listening area), and let the most critical listening positions determine the final clustering and characterization of the clusters.

In the previous example, the distance metric was defined relative to a listening position or -area that is user-centric. This makes sense in a lot of use cases where the intention is to optimize the sound experience in a certain position or area. However, loudspeaker arrays may also be used to influence interaction of the reproduced sound with the room. For example, sound may be directed towards a wall to result in virtual sound sources, or sound may be directed away from a wall, ceiling or floor to prevent strong reflections. In such use case it makes sense to define the distance metric relative to some aspects of the room geometry rather than to the listening position.

In particular, a projected distance metric between loudspeakers as described in the previous embodiment may be used, but now relative to a direction orthogonal to e.g. a wall. In this case, the resulting clustering and characterization of the subsets will be indicative of the array performance of the cluster in relation to the wall.

For simplicity, the examples described in detail above were presented in 2D. However, the methods described above apply to 3D loudspeaker configurations as well. Depending on the use case, one may carry out the clustering separately in the 2D horizontal plane and/or in one or more vertical planes, or in all three dimensions simultaneously. In the case that the clustering is carried out separately in the horizontal plane and in the vertical dimension, different clustering methods and distance metrics as described above may be used for the two clustering procedures. In the case that clustering is done in 3D (so in all three dimensions simultaneously), different criteria for maximum spacing may be used in the horizontal plane and in the vertical dimension. For example, whereas in the horizontal plane two loudspeakers may be considered to belong to the same cluster if their angular distance is less than 10 degrees, for two loudspeakers that are displaced vertically the requirement may be looser, e.g. less than 20 degrees.

The described approach may be used with a number of different rendering algorithms. Possible rendering algorithms may for example include:

Beamform Rendering:

Beamforming is a rendering method that is associated with loudspeaker arrays, i.e. clusters of multiple loudspeakers which are placed closely together (e.g. with less than several decimeters in between). Controlling the amplitude- and phase relationship between the individual loudspeakers allows sound to be "beamed" to specified directions, and/or sources to be "focused" at specific positions in front or behind the loudspeaker array. Detailed description of this method can be found in e.g. Van Veen, B. D, Beamforming: a versatile approach to spatial filtering, ASSP Magazine, IEEE (Volume: 5, Issue: 2), Date of Publication: April 1988. Although the article is described from the perspective of sensors (microphones), the described principles apply equally to beamforming from loudspeaker arrays due to the acoustic reciprocity principle.

Beamforming is an example of an array processing.

A typical use case in which this type of rendering is beneficial, is when a small array of loudspeakers is positioned in front of the listener, while no loudspeakers are present at the rear or even at the left and right front. In such cases, it is possible to create a full surround experience for the user by "beaming" some of the audio channels or objects to the side walls of the listening room. Reflections of the sound off the walls reach the listener from the sides and/or behind, thus creating a fully immersive "virtual surround" experience. This is a rendering method that is employed in various consumer products of the "soundbar" type.

Another example in which beamforming rendering can be employed beneficially, is when a sound channel or object to be rendered contains speech. Rendering these speech audio components as a beam aimed towards the user using beamforming may result in better speech intelligibility for the user, since less reverberation is generated in the room.

Beamforming would typically not be used for (sub-parts of) loudspeaker configurations in which the spacing between loudspeakers exceeds several decimeters.

Accordingly, beamforming is suitable for application in scenarios wherein one or more clusters are identified with a relatively high number of very closely spaced loudspeakers are found. Thus, for each of such clusters a beamforming rendering algorithm may be used, for example to generate perceived sound sources from directions in which no loudspeaker is present.

Cross-talk cancellation rendering:

This is a rendering method which is able to create a fully immersive 3D surround experience from two loudspeakers. It is closely related to binaural rendering over headphones using Head Related Transfer Functions (or HRTF's). Because loudspeakers are used instead of headphones, feedback loops have to be used to eliminate cross-talk from the left loudspeaker to the right ear and vice versa. Detailed description of this method can be found in e.g. Kirkeby, Ole; Rubak, Per; Nelson, Philip A.; Farina, Angelo, Design of Cross-Talk Cancellation Networks by Using Fast Deconvolution, AES Convention: 106 (May 1999) Paper Number: 4916.

Such a rendering approach may for example be suitable for a use case with only two loudspeakers in the frontal region, but where it is still desired to achieve a full spatial experience from this limited set-up. It is well-known that it is possible to create a stable spatial illusion to a single listening position using cross-talk cancellation especially when the loudspeakers are close to each other. If the loudspeakers are far from each other the resulting spatial image becomes more instable and sounds colored because of the complexity of the cross-path. The proposed clustering in this example can be used to decide whether a 'virtual stereo' method based on cross-talk cancellation and HRTF filters or plain stereo playback should be used.

Stereo Dipole Rendering:

This rendering method uses two or more closely-spaced loudspeakers to render a wide sound image for a user by processing a spatial audio signal in such a way that a common (sum) signal is reproduced monophonically, while a difference signal is reproduced with a dipole radiation pattern. Detailed description of this method can be found in e.g. Kirkeby, Ole; Nelson, Philip A.; Hamada, Hareo, The 'Stereo Dipole': A Virtual Source Imaging System Using Two Closely Spaced Loudspeakers, JAES Volume 46 Issue 5 pp. 387-395; May 1998.

Such a rendering approach may for example be suitable for use cases in which only a very compact set-up of a few (say 2 or 3) closely spaced loudspeakers directly in front of the listener is available to render a full frontal sound image.

Wave Field Synthesis Rendering:

This is a rendering method that uses arrays of loudspeakers to accurately recreate an original sound field within a large listening space. Detailed description of this method can be found in e.g. Boone, Marinus M.; Verheijen, Edwin N. G. Sound Reproduction Applications with Wave-Field Synthesis, AES Convention: 104 (May 1998) Paper Number: 4689.

Wave field synthesis is an example of an array processing.

It is particularly suitable for object-based sound scenes, but is also compatible with other audio types (e.g. channel- or scene-based). A restriction is that it is only suitable for loudspeaker configurations with a large number of loudspeakers spaced no more than about 25 cm apart. The rendering algorithm may in particular be applied if clusters are detected which comprises sufficient loudspeakers positioned very close together. In particular if the cluster spans a substantial part of at least one of the frontal, rear or side regions of the listening area. In such cases, the method may provide a more realistic experience than e.g. standard stereophonic reproduction.

Least Squares Optimized Rendering:

This is a generic rendering method that attempts to achieve a specified target sound field by means of a numerical optimization procedure in which the loudspeaker positions are specified as parameters and the loudspeaker signals are optimized such as to minimize the difference between the target- and reproduced sound fields within some listening area. Detailed description of this method can be found in e.g. Shin, Mincheol; Fazi, Filippo M.; Seo, Jeongil; Nelson, Philip A., Efficient 3-D Sound Field Reproduction, AES Convention: 130 (May 2011) Paper Number: 8404.

Such a rendering approach may for example be suitable for similar use cases as described for wave field synthesis and beam-forming.

Vector Base Amplitude Panning Rendering:

This is a method which is basically a generalization of the stereophonic rendering method that supports non-standardized loudspeaker configurations by adapting the amplitude panning law between pairs of loudspeakers to more than two loudspeakers placed in known two or three dimensional positions in space. Detailed description of this method can be found in e.g. V. Pulkki, "Virtual Sound Source Positioning Using Vector Base Amplitude Panning", J. AudioEng. Soc., Vol. 45, No. 6, 1997.

Such a rendering approach may for example be suitable for applying between clusters of loudspeakers where the distance between the clusters is too high to allow array processing to be used but still close enough to allow the panning to provide a reasonable result (in particular for the scenario where the distances of the loudspeakers are relatively large but they are (approximately) placed on a sphere around the listening area). Specifically, VBAP may be the "default" rendering mode for loudspeaker subsets that do not belong to a common identified cluster satisfying a certain maximum inter-loudspeaker spacing criterion.

As previously described, in some embodiments, the renderer is capable of rendering audio components in accordance with a plurality of rendering modes and the render controller 611 may select rendering modes for the loudspeakers 603 depending on the clustering.

In particular, the renderer 607 may be capable of performing array processing for rendering audio components using loudspeakers 603 that have a suitable spatial relationship. Thus, if the clustering identifies a cluster of loudspeakers 603 that meet a suitable distance requirement, the render controller 611 may select the array processing in order to render audio components from the loudspeakers 603 of the specific cluster.

An array processing includes rendering an audio component from a plurality of loudspeakers by providing the same signal to the plurality of loudspeakers except for one or more weight factors that may affect the phase and amplitude for the individual loudspeaker (or correspondingly a time delay and amplitude in the time domain). By adjusting the phase and amplitude, the interference between the different rendered audio signals can be controlled thereby allowing the overall rendering of the audio component to be controlled. For example, the weights can be adjusted to provide positive interference in some directions and negative interference in other directions. In this way, the directional characteristics may e.g. be adjusted and e.g. a beamforming may be achieved with main beams and notches in desired directions. Typically, frequency dependent gains are used to provide the desired overall effect.

The renderer 607 may specifically be capable of performing a beamforming rendering and a wave field synthesis rendering. The former may provide particularly advantageous rendering in many scenarios but requires the loudspeakers of the effective array to be very close together (e.g. no more than 25 cm apart). A wave field synthesis algorithm may be a second preferred option and may be suitable for interspeaker distances of perhaps up to 50 cm.

Thus, in such a scenario, the clustering may identify a cluster of loudspeakers 603 that have an interspeaker distance of less than 25 cm. In such a case, the render controller 611 may select to use beamforming to render an audio component from the loudspeakers of the cluster. However, if no such cluster is identified but instead a cluster of loudspeakers 603 that have an interspeaker distance of less than 50 cm is found, the render controller 611 may select a wave field synthesis algorithm instead. If no such cluster is found, another rendering algorithm may be used, such as e.g. a VBAP algorithm.

It will be appreciated that in some embodiments, a more complex selection may be performed, and in particular, different parameters of the clusters may be considered. For example, wave field synthesis may be preferred over beamforming if a cluster is found with a large number of loudspeakers with an interspeaker distance of less than 50 cm whereas a cluster with an interspeaker distance of less than 25 cm has only a few loudspeakers.

Thus, in some embodiments the render controller may select an array processing rendering for a first cluster in response to a property of the first cluster meeting a criterion. The criterion may for example be that the cluster comprises more than a given number of loudspeakers and the maximum distance between the closest neighbor loudspeakers is less than a given value. E.g. if more than three loudspeakers are found in a cluster with no loudspeaker being more than, say, 25 cm from another loudspeaker of the cluster, then a beamforming rendering may be selected for the cluster. If not, but if instead a cluster is found with more than three loudspeakers and with no loudspeaker being more than, say, 50 cm from another loudspeaker of the cluster, then a wave field synthesis rendering may be selected for the cluster.

In these examples, the maximum distance between closest neighbors of the cluster is specifically considered. A pair of closest neighbors may be considered to be a pair wherein a first loudspeaker of the cluster is the loudspeaker which is closest to the second loudspeaker of the pair in accordance with the distance metric. Thus, the distance measured using the distance metric from the second loudspeaker to the first loudspeaker is lower than any distance from the second loudspeaker to any other loudspeaker of the cluster. It should be noted that the first loudspeaker being the closest neighbor of the second loudspeaker does not necessarily mean that the second loudspeaker is also the closest neighbor of the first loudspeaker. Indeed, the closest loudspeaker to the first loudspeaker may be a third loudspeaker which is closer to the first loudspeaker than the second loudspeaker but further from the second loudspeaker than the first loudspeaker.

The maximum distance between closest neighbors is particularly significant for determining whether to use array processing as the efficiency of the array processing (and specifically the interference relationship) depends on this distance.

Another relevant parameter that may be used is the maximum distance between any two loudspeakers in the cluster. In particular, for efficient wave field synthesis rendering it is required that the overall size of the array used is sufficiently large. Therefore, in some embodiments, the selection may be based on the maximum distance between any pair of transducers in the cluster.

The number of loudspeakers in the cluster corresponds to the maximum number of transducers that can be used for the array processing. This number provides a strong indication of the rendering that can be performed. Indeed, the number of loudspeakers in the array typically corresponds to the maximum number of degrees of freedom for the array processing. For example, for a beamforming, it may indicate the number of notches and beams that can be generated. It may also affect how narrow e.g. the main beam can be made. Thus, the number of loudspeakers in a cluster may be useful for selecting whether to use array processing or not.

It will be appreciated that these characteristics of the cluster may also be used to adapt various parameters of the rendering algorithm that is used for the cluster. For example, the number of loudspeakers may be used to select where notches are directed, the distance between loudspeakers may be used when determining the weights etc. Indeed, in some embodiments, the rendering algorithm may be predetermined and there may be no selection of this based on the clustering. For example, an array processing rendering may be pre-selected. However, the parameters for the array processing may be modified/configured depending on the clustering.

Indeed, in some embodiments, the clusterer 609 may not only generate a set of clusters of loudspeakers but may also generate a property indication for one or more of the clusters, and the render controller 611 may adapt the rendering accordingly. For example, if a property indication is generated for a first cluster, the render controller may adapt the rendering for the first cluster in response to the property indication.

Thus, in addition to identifying the clusters, these can also be characterized to facilitate optimized sound rendering, for example by using them in a selection or decision procedure and/or by adjusting parameters of a rendering algorithm.

For example, as described for each of the identified clusters, the maximum spacing $\delta_{max}$ within that cluster may be determined, i.e. the maximum distance between closest neighbors may be determined. Also, the total spatial extent, or size, L of the cluster may be determined as the maximum distance between any two of the loudspeakers within the cluster.

These two parameters (possibly together with other parameters, such as the number of loudspeakers within the subset and their characteristics, e.g. their frequency bandwidth) can be used to determine a useable frequency range for applying array processing to the subset, as well as to determine applicable array processing types (e.g. beamforming, Wave Field Synthesis, dipole processing etc).

In particular, a maximum useable frequency $f_{max}$ of a subset can be determined as:

$$f_{max} \approx \frac{c}{2\delta_{max}} \text{Hz},$$

with c being the speed of sound.

Also, a lower limit of the useable frequency range for a subset may be determined as:

$$\lambda_{max} \approx L, \text{ or } f_{min} \approx \frac{c}{L},$$

which expresses that the array processing is effective down to a frequency $f_{min}$ for which the corresponding wavelength $\lambda_{max}$ is in the order of the total size L of the subset.

Thus, a frequency range restriction for a rendering mode may be determined and fed to the render controller 611 which may adapt the rendering mode accordingly (e.g. by selecting a suitable rendering algorithm).

It should be noted that the specific criteria for determining the frequency range may vary for different embodiments and the equations above are merely intended as illustrative examples.

In some embodiments, each of the identified subsets may thus be characterized by a corresponding useable frequency range $[f_{min}, f_{max}]$ for one or more rendering modes. This may e.g. be used to select one rendering mode (specifically an array processing) for this frequency range and another rendering mode for other frequencies.

The relevance of the determined frequency range depends on the type of array processing. For example, while for beamforming processing both $f_{min}$ and $f_{max}$ should be taken into account, $f_{min}$ is of less relevance for dipole processing. Taking these considerations into account, the values of $f_{min}$ and/or $f_{max}$ can be used to determine which types of array processing are applicable to a specific cluster, and which are not.

In addition to the parameters described above, each cluster may be characterized by one or more of its position, direction or orientation relative to a reference position. For determining these parameters, a center position of each cluster may be defined, e.g. the bisector of the angle between the two outermost loudspeakers of the cluster, as seen from the reference position, or a weighted centroid position of the cluster, which is an average of all the position vectors of all loudspeakers in the cluster relative to the reference position. Also these parameters may be used to identify suitable rendering processing techniques for each cluster.

In the previous examples, the clustering was performed based only on considerations of spatial distances between loudspeakers in accordance with the distance metric. However, in other embodiments, the clustering may further take other characteristics or parameters into account.

For example, in some embodiments, the clusterer 609 may be provided with rendering algorithm data which is indicative of characteristics of rendering algorithms that may be performed by the renderer. For example, the rendering algorithm data may specify which rendering algorithms that the renderer 607 is capable of performing and/or of restrictions for the individual algorithms. E.g. the rendering algorithm data may indicate that the renderer 607 is capable of rendering using VBAP for up to three loudspeakers; beamforming if the number of loudspeakers in the array is more than 2 but less than 6 and if the maximum neighbor distance is less than 25 cm, and wave field synthesis for up to 10 loudspeakers if the maximum neighbor distance is less than 50 cm.

The clustering may then be performed in dependence on the rendering algorithm data. For example, parameters of the clustering algorithm may be set in dependence on the rendering algorithm data. E.g. in the above example, the clustering may limit the number of loudspeakers to 10 and allow new loudspeakers to be included in an existing cluster only if the distance to at least one loudspeaker in the cluster is less than 50 cm. Following the clustering, rendering algorithms may be selected. E.g. if the number of loudspeakers is over 5 and the maximum neighbor distance is no more than 50 cm, wave field synthesis is selected. Otherwise, if there are more than 2 loudspeakers in the cluster, beamforming is selected. Otherwise, VBAP is selected.

If instead, the rendering algorithm data indicated that the rendering is only capable of rendering using VBAP or wave field synthesis if the number of loudspeakers in the array is more than 2 but less than 6 and if the maximum neighbor distance is less than 25 cm, then the clustering may limit the number of loudspeakers to 5 and allow new loudspeakers to be included in an existing cluster only if the distance to at least one loudspeaker in the cluster is less than 25 cm.

In some embodiments, the clusterer 609 may be provided with rendering data which is indicative of acoustic rendering characteristics of at least some loudspeakers 603. Specifically, the rendering data may indicate a frequency response of the loudspeakers 603. For example, the rendering data may indicate whether the individual loudspeaker is a low frequency loudspeaker (e.g. woofer), a high frequency loudspeaker (e.g. tweeter) or a wideband loudspeaker. This information may then be taken into account when clustering. For example, it may be required that only loudspeakers having corresponding frequency ranges are clustered together thereby avoiding e.g. clusters comprising of woofers and tweeters which are unsuitable for e.g. array processing.

Also, the rendering data may indicate a radiation pattern of the loudspeakers 603 and/or orientation of the main acoustic axis of the loudspeakers 603. For example, the rendering data may indicate whether the individual loudspeaker has a relatively broad or relatively narrow radiation pattern, and to which direction the main axis of the radiation pattern is oriented. This information may be taken into account when clustering. For example, it may be required that only loudspeakers are clustered together for which the radiation patterns have sufficient overlap.

As a more complex example, the clustering may be performed using unsupervised statistical learning methods. Each loudspeaker k can be represented by a feature vector in a multi-dimensional space, e.g, $$v_k=(x_k,y_k,z_k,s_k,\alpha_k)^T$$

where the coordinates in 3D space are $x_k$, $y_k$, and $z_k$. The frequency response in this embodiment may be characterized by a single parameter $s_k$ which may represent, for example, the spectrum centroid of the frequency response. Finally the horizontal angle in relation to a line from the loudspeaker position to the listening position is given by $\alpha_k$. In the example, the clustering is performed taken the whole feature vector into account. In parametric unsupervised learning, one first initializes N cluster centers $a_n$, n=0 . . . N−1 in the feature space. They are typically initialized randomly or sampled from the loudspeaker positions. Next the positions of $a_n$ are updated such that they better represent the distribution of the loudspeaker positions in the feature space. There are various methods for performing this, and it is also possible to split and regroup clusters during the iteration in a similar way to what has been described in the context or hierarchical clustering above.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An audio apparatus comprising:

a receiver configured to receive audio data and audio transducer position data for a plurality of audio transducers;

a renderer configured to render the audio data by generating audio transducer drive signals for the plurality of audio transducers from the audio data;

a clusterer configured to cluster the plurality of audio transducers into a set of audio transducer clusters in response to distances between audio transducers of the plurality of audio transducers in accordance with a spatial distance metric, the distances being determined from the audio transducer position data and the clustering comprising generating the set of audio transducer clusters in response to an iterated inclusion of audio transducers to clusters of a previous iteration, where a first audio transducer is included in a first cluster of the set of audio transducer clusters in response to the first audio transducer meeting a distance criterion with respect to one or more audio transducers of the first cluster; and a render controller configured to adapt the rendering in response to the clustering.

2. The audio apparatus of claim 1, wherein the renderer is configured to render the audio data in accordance with a plurality of rendering modes; and the render controller is configured to independently select rendering modes from the plurality of rendering modes for different co-existing audio transducer clusters.

3. The audio apparatus of claim 2, wherein the renderer is configured to perform an array processing rendering; and the render controller is configured to select an array processing rendering for a first cluster of the set of audio transducer clusters in response to a property of the first cluster meeting a criterion.

4. The audio apparatus of claim 1, wherein the renderer is configured to perform an array processing rendering; and the render controller is arranged to adapt the array processing rendering for a first cluster of the set of audio transducer clusters in response to a property of the first cluster.

5. The audio apparatus of claim 3 wherein the property is at least one of a maximum distance between audio transducers of the first cluster being closest neighbors in accordance with the spatial distance metric; a maximum distance between audio transducers of the first cluster in accordance with the spatial distance metric; and a number of audio transducers in the first cluster.

6. The audio apparatus of claim 1 wherein the clusterer is configured to generate a property indication for a first cluster of the set of audio transducer clusters; and the render controller is configured to adapt the rendering for the first cluster in response to the property indication.

7. The audio apparatus of claim 6 wherein the property indication is indicative of at least one property selected from the group of:

a maximum distance between audio transducers of the first cluster being closest neighbors in accordance with the spatial distance metric; and a maximum distance between any two audio transducers of the first cluster.

8. The audio apparatus of claim 6 wherein the property indication is indicative of at least one property selected from the group of:

a frequency response of one or more audio transducers of the first cluster;

a number of audio transducers in the first cluster;

an orientation of the first cluster relative to at least one of a reference position and a geometric property of the rendering environment; and a spatial size of the first cluster.

9. The audio apparatus of claim 1, wherein the clusterer is configured to generate the set of audio transducer clusters subject to a requirement that in a cluster no two audio transducers being closest neighbors in accordance with the spatial distance metric has a distance exceeding a threshold.

10. The audio apparatus of claim 1, wherein the clusterer is further configured to receive rendering data indicative of acoustic rendering characteristics of at least some audio transducers of the plurality of audio transducers, and to cluster the plurality of audio transducers into the set of audio transducer clusters in response to the rendering data.

11. The audio apparatus of claim 1, wherein the clusterer is further configured to receive rendering algorithm data indicative of characteristics of rendering algorithms that can be performed by the renderer, and to cluster the plurality of audio transducers into the set of audio transducer clusters in response to the rendering algorithm data.

12. The audio apparatus of claim 1 wherein the spatial distance metric is an angular distance metric reflecting an angular difference between audio transducers relative to a reference position or direction.

13. A method of audio processing, the method comprising acts of:

receiving audio data and audio transducer position data for a plurality of audio transducers;

rendering the audio data by generating audio transducer drive signals for the plurality of audio transducers from the audio data;

clustering the plurality of audio transducers into a set of audio transducer clusters in response to distances between audio transducers of the plurality of audio transducers in accordance with a spatial distance metric, the distances being determined from the audio transducer position data and the clustering comprising generating the set of audio transducer clusters in response to an iterated inclusion of audio transducers to clusters of a previous iteration, where a first audio transducer is included in a first cluster of the set of audio transducer clusters in response to the first audio transducer meeting a distance criterion with respect to one or more audio transducers of the first cluster; and adapting the rendering in response to the clustering.

14. A computer readable storage medium that is not a transitory propagating wave or signal comprising computer instructions which, when executed by an audio apparatus, configure the apparatus to perform the acts of:

receiving audio data and audio transducer position data for a plurality of audio transducers;

rendering the audio data by generating audio transducer drive signals for the plurality of audio transducers from the audio data;

clustering the plurality of audio transducers into a set of audio transducer clusters in response to distances between audio transducers of the plurality of audio transducers in accordance with a spatial distance metric, the distances being determined from the audio transducer position data and the clustering comprising generating the set of audio transducer clusters in response to an iterated inclusion of audio transducers to clusters of a previous iteration, where a first audio transducer is included in a first cluster of the set of audio transducer clusters in response to the first audio transducer meeting a distance criterion with respect to one or more audio transducers of the first cluster; and adapting the rendering in response to the clustering.

* * * * *